US007544255B2

(12) United States Patent
Takayama

(10) Patent No.: US 7,544,255 B2
(45) **Date of Patent: *Jun. 9, 2009**

(54) ROLLING ELEMENT

(75) Inventor: Takemori Takayama, Hirakata (JP)

(73) Assignee: Komatsu Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/234,959

(22) Filed: Sep. 26, 2005

(65) Prior Publication Data

US 2006/0016519 A1 Jan. 26, 2006

Related U.S. Application Data

(62) Division of application No. 10/790,959, filed on Mar. 1, 2004.

(30) Foreign Application Priority Data

Mar. 4, 2003 (JP) ..... 2003-057388
Feb. 9, 2004 (JP) ..... 2004-31702

(51) Int. Cl.
*C22C 38/24* (2006.01)
*C22C 38/26* (2006.01)
*C22C 38/28* (2006.01)

(52) U.S. Cl. ..... 148/318; 148/319; 384/912; 384/625

(58) Field of Classification Search ..... 148/233, 148/229, 906, 319, 318; 384/912, 625
See application file for complete search history.

(56) References Cited

U.S. PATENT DOCUMENTS 3,663,314 A * 5/1972 Monma et al. ..... 148/333

(Continued)

FOREIGN PATENT DOCUMENTS

CN 1380435 A 11/2002

(Continued)

OTHER PUBLICATIONS

"Heat Treatment of Steel" (5th Edition), Edited by: The Iron and Steel Institute of Japan, Publ. Office: Maruzen Co., Ltd., Mar. 15, 1985, pp. 44 to 46 and 110.

(Continued)

*Primary Examiner*—Deborah Yee
(74) *Attorney, Agent, or Firm*—Frishauf, Holtz, Goodman & Chick, P.C.

(57) ABSTRACT

Various inexpensive rolling elements for use under high interface pressure such as induction hardened gears are provided, which have improved seizure resistance at tooth flanks and a temper hardness of HRC 50 or more at 300° C. To this end, a rolling element is made from a steel material which contains at least 0.5 to 1.5 wt % carbon and 0.2 to 2.0 wt % one or more alloy elements selected from V, Ti, Zr, Nb, Ta and Hf; and in which 0.4 to 4.0% by volume one or more compounds selected from the carbides, nitrides and carbonitrides of the above alloy elements and having an average particle diameter of 0.2 to 5 μm are dispersed. In such a rolling element, the soluble carbon concentration of a martensite parent phase of a rolling contact surface layer is adjusted to 0.3 to 0.8 wt %, the martensite parent phase having been subjected to induction hardening and low temperature tempering, and one or more of the above carbides, nitrides and carbonitrides are dispersed in an amount of 0.4 to 4.0% by volume within the martensite parent phase.

13 Claims, 18 Drawing Sheets

U.S. PATENT DOCUMENTS

| | | | | |
|---|---|---|---|---|
| RE28,523 | E | 8/1975 | Hill et al. | |
| 3,929,523 | A | 12/1975 | Kinoshi et al. | |
| 4,162,157 | A | 7/1979 | Parker et al. | |
| 4,992,111 | A | 2/1991 | Yamada et al. | |
| 5,085,733 | A * | 2/1992 | Mitamura | 148/319 |
| 5,131,965 | A | 7/1992 | McVicker | |
| 5,338,377 | A * | 8/1994 | Mitamura et al. | 148/318 |
| 5,413,643 | A * | 5/1995 | Murakami et al. | 148/319 |
| 5,725,690 | A | 3/1998 | Ochi et al. | |
| 5,906,691 | A * | 5/1999 | Burnett et al. | 148/567 |
| 6,171,414 | B1 * | 1/2001 | Mitamura et al. | 148/333 |
| 6,224,688 | B1 * | 5/2001 | Takemura et al. | 148/318 |
| 6,258,179 | B1 | 7/2001 | Takayama et al. | |
| 6,309,475 | B1 * | 10/2001 | Takayama et al. | 148/232 |
| 6,413,328 | B2 * | 7/2002 | Takayama et al. | 148/319 |
| 6,540,847 | B1 * | 4/2003 | Beswick | 148/334 |
| 6,899,774 | B2 | 5/2005 | Takayama et al. | |
| 7,083,688 | B2 | 8/2006 | Asano et al. | |
| 2002/0029597 | A1 | 3/2002 | Choe et al. | |
| 2004/0035499 | A1 | 2/2004 | Takayama et al. | |
| 2004/0047757 | A1 | 3/2004 | Takayama | |
| 2004/0256029 | A1 | 12/2004 | Takayama et al. | |
| 2005/0051240 | A1 | 3/2005 | Takayama | |
| 2005/0241734 | A1 | 11/2005 | Takayama et al. | |
| 2005/0247377 | A1 | 11/2005 | Takayama et al. | |
| 2006/0021679 | A1 | 2/2006 | Takayama et al. | |

FOREIGN PATENT DOCUMENTS

| | | | |
|---|---|---|---|
| EP | 0950723 | | * 10/1999 |
| JP | 48-23617 | A | 3/1973 |
| JP | 49-7117 | A | 1/1974 |
| JP | 55-12177 | B2 | 1/1977 |
| JP | 57-16186 | B2 | 3/1977 |
| JP | 57-19183 | B2 | 3/1978 |
| JP | 54-10923 | B2 | 5/1979 |
| JP | 54-23329 | B2 | 8/1979 |
| JP | 54-124816 | A | 9/1979 |
| JP | 54-143715 | A | 11/1979 |
| JP | 55-2789 | A | 1/1980 |
| JP | 55-12184 | B2 | 3/1980 |
| JP | 57-10177 | B2 | 2/1982 |
| JP | 57-89424 | A | 6/1982 |
| JP | 57-174434 | A | 10/1982 |
| JP | 5-59427 | B2 | 3/1984 |
| JP | 59-107066 | A | 6/1984 |
| JP | 59-136451 | A | 8/1984 |
| JP | 60-5854 | A | 1/1985 |
| JP | 360162726 | * | 8/1985 |
| JP | 60-215743 | | 10/1985 |
| JP | 61-009555 | A | 1/1986 |
| JP | 62-218542 | A | 9/1987 |
| JP | 64-004459 | A | 1/1989 |
| JP | 5-32462 | B2 | 7/1989 |
| JP | 2-175836 | A | 7/1990 |
| JP | 2-185954 | A | 7/1990 |
| JP | 402173241 | * | 7/1990 |
| JP | 03-061348 | A | 3/1991 |
| JP | 7-74380 | B2 | 10/1991 |
| JP | 05-078781 | | 3/1993 |
| JP | 3227730 | B2 | 3/1993 |
| JP | 6-017224 | A | 1/1994 |
| JP | 406025736 | * | 2/1994 |
| JP | 8-3629 | A | 1/1996 |
| JP | 08-073929 | A | 3/1996 |
| JP | 08-104924 | A | 4/1996 |
| JP | 8-109435 | | 4/1996 |
| JP | 9-111403 | | 4/1997 |
| JP | 9-111405 | A | 4/1997 |
| JP | 10-176219 | A | 6/1998 |
| JP | 10-259470 | A | 9/1998 |
| JP | 11-117059 | A | 4/1999 |
| JP | 11-222627 | A | 8/1999 |
| JP | 2000-204464 | A | 7/2000 |
| JP | 2000-265241 | A | 9/2000 |
| JP | 2000-301458 | A | 10/2000 |
| JP | 2002-030344 | A | 1/2002 |
| JP | 2002-121645 | | 4/2002 |
| JP | 2002-180183 | A | 6/2002 |
| JP | 2003-328078 | A | 11/2002 |
| JP | 2003-027181 | A | 1/2003 |
| JP | 2004-076125 | A | 3/2004 |

OTHER PUBLICATIONS

Brick et al., "Structure and Properties of Engineering Materials," Martensite Transformation in Iron-Carbon Alloys, 4th Edition, (1978), pp. 152-154.

"Heat Treatment of Steel" (5th Edition) Edited by: The Iron and Steel Institute of Japan, Publ. Office: Maruzen Co., Ltd., Mar. 15, 1985.

K. Komine et al., On Relationship Between Half Value Breadth and Hardness of Quenched-Tempered Steels; Materials vol. 26, No. 280, P26 issued by Society of Materials, Japan, pp. 24-30; Jun. 21, 1976.

J.R. Davis, "ASM Metals Handbook", Second Edition, (1998).

* cited by examiner 4 (b)

4 (a)

14 (a)

14 (b)

14 (c)

ROLLING ELEMENT

CROSS-REFERENCE TO RELATED APPLICATION

This application is a Divisional application of U.S. application Ser. No. 10/790,959, filed on Mar. 1, 2004.

BACKGROUND ART

The present invention relates to a rolling element such as gears and a method of its production, the rolling element being produced by quench-hardening its rolling contact surface layer through treatment such as induction hardening, carburizing/quenching, carbonitriding/quenching or nitriding/quenching.

TECHNICAL FIELD

Up to now, there have been commonly used, in the reducers of construction machines and earth-moving machines, gears produced by applying carburizing/quenching or carbonitriding/quenching to SCr-based, SCM-based or SNCM-based low carbon steel, since high contact fatigue strength (no less than 200 kgf/mm$^2$) is considered to be an important factor. Some ring gears used under comparatively low interface pressure (up to 150 kgf/mm$^2$) are produced by applying thermal treatment such as induction hardening to middle carbon steel or middle carbon low alloy steel (0.45 to 0.6 wt % C).

Reducers employed in construction machines and earth-moving machines require less expensive gears having higher strength and higher resistance to interface pressure, because of the recent tendency to higher output power and compactness.

Construction machines and earth-moving machines often s tride obstacles such as rocks and structures during traveling and break up such obstacles while making a turn. Therefore, the gears of the reducer used for running and turning the vehicle body receive impulsive load. Under such a condition, carburized/quenched gears are susceptible to damage.

Induction hardened gears have higher toughness than carburized/quenched gears, but where induction hardened gears are used under a high interface pressure of 150 kgf/mm$^2$ or more as noted earlier, defects in terms of contact fatigue strength (e.g., pitting, scuffing and premature wear) are likely to occur. Carburized/quenched gears do not have enough durability to withstand a high interface pressure of 230 kgf/mm$^2$ or more and therefore do not provide satisfactory contact fatigue strength for miniaturization.

The invention is directed to overcoming the above problems and therefore the invention aims to improve the seizure resistance of the tooth flanks of a gear used under a rolling/sliding condition by dispersing one or more kinds of compounds selected from the carbides, nitrides and/or carbonitrides of V, Ti, Zr, Nb, Ta and Hf which are hardly solid-dissolved in austenite by induction hardening of the rolling contact surface. This idea is conceived from the fact that the temperature of the tooth flanks of a gear used under a rolling/sliding condition increases up to 300° C. owing to heat generation caused by local adhesion that occurs in a lubricated interface. The invention also aims to provide an inexpensive rolling element used under high interface pressure such as induction hardened gears, the rolling element having a temper hardness of HRC 50 or more at 300° C. Such a rolling element is produced from a steel material containing a large amount of Al and/or Si which effectively enhances temper softening resistance in low-temperature tempering at 300° C. The invention further aims to provide a rolling element and the producing method thereof, the rolling element being achieved by proper co-addition of Al and Ni to the above steel material and exerting high toughness even in a highly hardened condition.

DISCLOSURE OF THE INVENTION

SNCM815, SCM420, SCr420, SMnB420 steels (carburized case-hardened steels) which had been subjected to carburizing/quenching were preliminarily checked in terms of rolling contact fatigue strength (pitting resistance) at interface pressures of 375 to 220 kgf/mm$^2$ under a rolling/sliding condition. As a result, it was found that the interface pressure at which pitting appeared after $10^7$ rotations was 210 kgf/mm$^2$ and the X-ray half value width of the martensite phase of the outermost layer of the rolling contact surface in which pitting occurred under each interface pressure decreased to 4-4.2°, and significant softening was observed at the outermost layer of the rolling contact surface of each steel.

An S55C carbon steel which had been subjected to quenching/tempering so as to have HRC 61 to 62 was preliminarily checked in terms of rolling contact fatigue strength at an interface pressure of 250 kgf/mm$^2$. As a result, it was found that the interface pressure at which pitting appeared after $10^7$ rotations was about 180 kgf/mm$^2$ and the X-ray half value width of the martensite phase of the rolling contact surface in which pitting occurred under an interface pressure of 250 kgf/mm$^2$ decreased to 3.6-4.2° similarly to the above-described carburized, case-hardened steels.

A preliminary test was also conducted on an eutectoid carbon steel (1) (0.77 wt % C) to check its rolling contact fatigue strength. As a result, it was found that the interface pressure at which pitting appeared after $10^7$ rotations was about 230 to 240 kgf/mm$^2$ which was substantially the same as the rolling contact fatigue strength of the aforesaid carburized, case-hardened steels having substantially the same carbon content. Also, a decrease in rolling contact fatigue strength due to its variation was observed in the carburized case-hardened steels because of the presence of an intergranular oxidation layer and a slack-quenched layer in the rolling contact surface.

A preliminary test was further conducted on a spheroidal eutectoid carbon steel (2) (0.82 wt % C, 0.43 wt % Cr), whose rolling contact surface had been subjected to induction hardening, to check its rolling contact fatigue strength and it was found that the interface pressure at which pitting appeared after $10^7$ rotations was about 260 to 270 kgf/mm$^2$ and this eutectoid carbon steel (2) had higher rolling contact fatigue strength than the former eutectoid steel (1) (0.77 wt % C) because of the dispersion of about 2% by volume of fine cementite particles in the martensite phase of the rolling contact surface.

From the viewpoint of the dispersion of fine cementite particles (about 2% by volume) and achievement of increased martensitic hardness, a SUJ2 containing about 1.0 wt % carbon and 1.5 wt % Cr was quenched from 840° C. and then tempered to have HRC 62.5. The rolling contact fatigue strength of this steel was checked in a preliminary test and it was found that the interface pressure at which pitting appeared after $10^7$ rotations was about 270 kgf/mm$^2$ which was approximately the same as that of the above eutectoid steel and that the X-ray half value width of the martensite phase of the rolling contact surface in which pitting occurred under an interface pressure of 250 kgf/mm$^2$ decreased to 4.2-4.5° similarly to the carburized, case-hardened steels described above. Further, the rolling contact fatigue strength of another SUJ2, which had been spheroidized and induction hardened at a heating temperature of 950 to 980° C. with a view to dispersing a larger amount of fine cementite particles, was found to be increased to 300 kgf/mm$^2$ compared to the above-described SUJ2 quenched from 840° C. The reason for this is that about 10% by volume fine cementite particles disperse in the martensite phase of the rolling contact surface having a soluble carbon concentration of 0.35 wt %. It was also found that the lower limit of the amount of dispersed fine cementite particles was 2% by volume and more preferably 5% by volume and that the upper limit of it was 10% by volume or more.

Further, carbon steels having carbon contents of 0.46, 0.55, 0.66, 0.77 and 0.85 wt % respectively were quenched from a temperature of 820° C. and tempered at 100 to 350° C. for 3 hours. Then, the hardness and X-ray half value width of each steel were checked. After the test result was studied using, as a reference, published data on these steels (e.g., "Materials" Vol. 26, No. 280, P26), it was found that the hardness when the X-ray half value width of the martensite phase is 4 to 4.2° corresponds to a temper hardness of about HRC 51 to 53. Taking account of the fact that the surface carbon concentrations of the carburized, case-hardened steels were adjusted to about 0.7 to 0.9 wt %, the tempering temperature was found to be about 300° C.

It is obvious from the preliminary tests described above that the outermost surface of a tooth flank is tempered and softened by heat generated at the time when the gears come into engagement under high interference pressure so that pitting occurs, and that as an index, a 300° C.-temper hardness of HRC 53 or more is necessary for obtaining the same level of pitting resistance as that of carburized quenched gears.

From the comparison between the 300° C.-temper hardness of the carburization-hardened layer of the SCM420 steel which has undergone carburizing/quenching and the 300° C.-temper hardness of the eutectoid carbon steel which has undergone quenching only, it has been understood that since virtually no improvement in temper softening resistance was observed when Cr and Mo were added, a new alloy design intended for increasing temper softening resistance during low-temperature tempering at about 300° C. is necessary in order to achieve pitting resistance equal to or higher than that of carburized, quenched gears by induction hardening. Also, dispersion of fine cementite particles or the like having a particle diameter of 0.1 to 1.5 μm in the martensite phase has proved effective for attaining improved contact fatigue strength, as seen from the cases of the eutectoid carbon steel (2) (0.85 wt % C) and SUJ2 Which were improved in rolling contact fatigue strength. Further, a preferable average particle diameter of the cementite particles was found to be 1.5 μm or less.

The mechanism of the improvement of contact fatigue strength by dispersion of the cementite particles is as follows. The seizure resistance of the rolling contact surface during sliding with the interface being in a lubricated condition can be significantly improved by dispersion of hard cementite. More particularly, cementite dispersion leads to a drop in the temperature of the outermost layer of the rolling contact surface and to improved wear resistance, so that the seizure resistance is improved (this is hereinafter called "the hard particle dispersion effect). The seizure resistance can be more effectively improved by using, as the hard particles, MC-type carbides, M(C,N) carbonitrides, and MN-type nitrides of V, Ti, Zr, Nb, Ta, Hf and the like which hardly adhere to steel (described later).

As an induction hardened gear design value which provides pitting resistance equal to or higher than the pitting resistance obtained by the carburizing/quenching treatment (interface pressure Pmax=230 kgf/mm$^2$ or more) described earlier, the hardness which can withstand fatigue caused by pulsating shear stress (R=0) which is 0.3 times the value of interface pressure may be set based on the theoretical analysis of Hertz's contact pressure. Its calculated value is approximately HRC 53.4 which coincides with the hardness (HRC=53) obtained from the X-ray half value width of the martensite phase of the rolling contact surface in which occurrence of pitting was observed in the above-described preliminary test. Since pitting occurs at the time when the temperature of the outermost portion of the rolling contact surface increases to about 300° C. owing to friction heat generated by the rolling/sliding movement of the rolling element, it has been found that a highly pressure-resistant gear having interface pressure resistance equal to or higher than that of carburized quenched gears can be developed by at least setting the 300° C.-temper hardness to HRC 53 or more which can withstand Pmax=230 kgf/mm$^2$.

As will be described in Example 2, the 300° C.-temper hardness of the martensite phase of a carbon steel containing 0.1 to 1.0 wt % carbon is described by:

$$HRC=36\times\sqrt{C\ (wt\ \%)}+20.9$$

After checking, based on the above hardness, the influences of various alloy elements upon the hardness of a martensite phase after tempering at 300° C., it has become apparent that the hardness of a martensite phase after tempering at 300° C. is represented by:

$$HRC=(36\times\sqrt{C\ (wt\ \%)}+20.9)+4.33\times Si\ (wt\ \%)+7.3\times Al\ (wt\ \%)+3.1\times V\ (wt\ \%)+1.5\times Mo\ (wt\ \%)+1.2\times Cr\ (wt\ \%)\times(0.45\div C\ (wt\ \%))$$

In the invention, the amount (wt%) of each alloy element contained in the above steels is determined as follows based on the above-described gear materials and thermal treatment designs.

To sum up, according to the invention, there is provided a rolling element which is made from a steel material which contains at least 0.5 to 1.5 wt % C and 0.2 to 2.0 wt % one or more alloy elements selected from V, Ti, Zr, Nb, Ta and Hf and in which 0.4 to 4.0% by volume one or more compounds selected from the carbides, nitrides and carbonitrides of the above alloy elements and having an average particle diameter of 0.2 to 5 μm are dispersed;

wherein the soluble carbon concentration of a martensite parent phase of a rolling contact surface layer is adjusted to 0.3. to 0.8 wt %, the martensite parent phase having been subjected to induction heating quenching and low temperature tempering; and wherein one or more of the above carbides, nitrides and carbonitrides are dispersed in an amount of 0.4 to 4.0% by volume within the martensite parent phase.

It is well known that the above-described hard particle dispersion effect starts to work when the amount of the dispersing hard particles is 0.1% by volume or more and that if its amount exceeds 5.0% by volume, the seizure resistance decreases because of an increase in the friction coefficient and the likelihood of attacking the mating part becomes significant. In view of this, in the invention, the lower limit of the amount of one or more of the carbides, nitrides and carbonitrides is set to 0.4% by volume by which the hard particle dispersion effect more clearly appears and the upper limit of the same is set to 4.0% by volume. However, it is obviously more desirable to set the upper limit to 2.0% by volume, when taking account of the attacking probability and economical efficiency.

As an example, there will be explained a case where TiC and $V_4C_3$ are used as the hard particles. The specific gravities of TiC and $V_4C_3$ are 4.9 gr/cm$^3$ and 5.65 gr/cm$^3$ respectively. Therefore, addition of 0.2 wt % Ti forms about 0.4% by volume TiC (0.25 wt % TiC). Regarding $V_4C_3$, the amount of V solid-dissolved in the austenite is not negligible (0.3 wt % V maximum), depending on induction heating conditions, and addition of 2.0 wt % V forms about 2% by volume $V_4C_3$. In view of these facts, the amount of the alloy elements that constitute the carbides, nitrides and/or carbonitrides is set to 0.2 to 2.0 wt %.

For the steel material having carbides dispersed therein, it is necessary to determine the carbon content of the steel material, taking account of the amount of carbon to be consumed by the formation of the carbides and the soluble carbon amount (0.3 to 0.9 wt %) required for obtaining a high-hardness, high-toughness martensite parent phase by the various quenching techniques described above. Accordingly, the carbon content of the rolling contact surface layer of the invention is set to 0.5 to 1.5 wt %. In the case of rolling elements in which the rolling contact surface layer is quench-hardened by induction hardening or induction hardening after nitriding, carburizing or carbonitriding, the carbon content of the steel material used is 0.5 to 1.5 wt %. In the case of rolling elements in which the rolling contact surface layer is quench-hardened by oil quenching after nitriding, carburizing or carbonitriding, it is apparently desirable to set the carbon content of the steel material to 0.2 to 0.8 wt %.

In order to effectively improve the seizure resistance and wear resistance of the rolling contact surface, it is necessary to precipitately disperse the carbides, nitrides and/or carbonitrides having relatively large particle size in the casting stage of the steel material. The average particle diameter of these compounds is preferably 0.2 μm or more, in consideration of the particle diameter of the dispersing cementite (0.2 to 1.5 μm) of the SUJ2 described earlier. In view of the probability of attacking the mating part during sliding, it is desirable to set the particle diameter to 5 μm or less. (Although the hard particles become finer in some forging conditions after casting, TiC particles (described later) having a size of 5 μm or less and $V_4C_3$ particles having a size of 2 μm or less are substantially uniformly dispersed.)

In cases where the above rolling element is used as a gear, there is a possibility that the carbides, nitrides and/or carbonitrides and the cementite may notch the inside of the gear, leading to a decrease in the bending fatigue strength of the roots of the teeth. Therefore, the invention takes the following measures. Specifically, by quenching after short-time induction heating the rolling contact surface layer, the prior austenite grains of the rolling contact surface layer are fined so as to have a particle diameter equal to or larger than ASTM No. 10, whereby 10 to 50% by volume retained austenite is formed and compressive residual stress is added. Further, shot peening is applied to the tooth flanks and tooth roots to impart a compressive residual stress of 50 kgf/mm$^2$ or more to the outermost surface of the rolling contact surface layer.

The hard particle dispersion effect will be explained. It has been confirmed as discussed later that an induction hardened gear made from a carbon steel (S55C) containing TiC and $V_4C_3$ (No. P7, No. P2) dispersed therein has substantially the same contact fatigue strength as that of the SCM420 carburized gear. From this, it is understood that the hard particle dispersion effect is attributable to an improvement in the resistance of the tooth flanks to seizure occurring when the gear slides under a high interface pressure and to restraints on the occurrence of scoring and a rise in the temperature of the tooth flanks. Therefore, this effect is beneficial to production of inexpensive induction hardened gears. In the invention, with the intention of attaining more improved contact fatigue strength and producing a compact high-strength gear, induction hardening in which quenching is carried out after short-time induction heating (900 to 1050° C.) is employed, whereby fine cementite particles having a particle size of 1 μm or less are added to the martensite parent phase of the rolling contact surface layer so that 10% by volume cementite particles are dispersed. In addition, the invention employs a steel material containing Si and/or Al which provides improved temper softening resistance in low temperature tempering.

The hardness of the above-described cementite is about Hv 850 to 1000 which does not largely differ from the hardness of the martensite parent phase and therefore the mating member is less likely to be attacked and the degree of the hard particle dispersion effect is small. When the cementite dispersion amount (about 10% by volume) of the induction hardened rolling contact surface layer of the SUJ2 is taken into account, an effective amount of the cementite is 10% by volume. With a view to achieving more improved contact fatigue strength, the upper limit of the amount of the dispersing cementite is preferably set to 15% by volume.

The heating temperature in the induction hardening is much higher (900 to 1050° C.) than the quenching temperature employed in carburizing/quenching treatment and the like mainly carried out by furnace heating. Therefore, it is difficult to form a quench hardened layer having cementite dispersed therein in the surface layer of a rolling element made from, for example, carbon steel that is commonly used for induction hardening. In addition, where a low alloy steel is used, a quench hardened layer having cementite dispersed therein cannot be formed in a martensite phase having a desired carbon concentration. To solve this problem, the invention uses a technique in which when a ferrite phase (alpha-Fe phase) and cementite coexist, the alloy element Cr which most significantly concentrates in cementite is added to a steel product in the range of 0.3 to 1.5 wt % and 2.5 to 10.0 wt % Cr is condensed in the cementite while the solid dissolving of the cementite into austenite is retarded by rapid induction heating to a quenching temperature. By retarding the solid dissolving of the cementite, the concentration of the carbon solid-dissolved in the austenite is controlled.

The Cr concentration of the cementite of a steel to be subjected to the induction hardening is dependent on the Cr concentration of the cementite of the dual phase (ferrite and cementite) structure that is a precursor to the cementite. For instance, it is known that if a dual phase structure is sufficiently heated at 700° C., the Cr concentration of the cementite is increased to about 28 times that of the ferrite (if the dual phase structure is heated at 600° C., the Cr concentration of the cementite is about 35 times that of the ferrite). This cementite in which Cr is condensed solid-dissolves in the austenite being heated. The solid dissolving mechanism (speed) of the cementite at that time can be explained from the relationship between the Fe—C-M (alloy element) ternary system phase diagram shown in FIG. 1 (heating temperature is a parameter) and the iso-activity lines for carbon (iso-carbon activity graph) plotted in FIG. 1.

FIG. 1 graphically shows an iso-thermal section plotted in relation with quenching temperatures in induction heating in the Fe—C-M ternary phase diagram of steel materials used in the invention to which an alloy element similar to Cr having strong affinity with respect to carbon is added as a chief component. In this diagram, the activity of carbon contained in the steel having a composition indicated by the point A changes as indicated by an upward-sloping curve (the thin line passing through the point A in FIG. 1), because the carbon activity drops with addition of the element M. This iso-carbon-activity line intersects the solid solubility line of cementite at the intersection point B which is linearly connected to the cementite composition point C indicative of a cementite composition containing the element M that is in equilibrium with the intersection point B.

Other iso-carbon-activity lines (other thin lines in FIG. 1) are calculated based on the carbon activities of other steel materials. The higher the carbon concentration is, the greater the carbon activity is. The solid solubility (the point D) of graphite in Fe—C axis (Fe—C binary system) is defined by carbon activity Ac=1.

The ferrite composition and cementite composition of the structure before quenching of the steel material having the composition indicated by the point A of FIG. 1 are given by the points E and F, respectively. If the steel material is rapidly heated to the quenching temperature, the alloy element M contained in the cementite having the composition indicated by the point F remains in situ while only carbon having great diffusivity rapidly solid-dissolves in the austenite. In this case, the austenite interface composition that is locally in equilibrium with the cementite is given by the point G. Since the carbon activity of the point G is greater than the carbon activity of the point A indicative of the composition of the steel material, carbon rapidly diffuses because of the gradient of the chemical potential of carbon and the cementite evanishes within an extremely short time. After the disappearance of the cementite, the alloy element is homogenized (indicated by arrows ←→) toward the composition point A on the iso-carbon-activity line of FIG. 1, at the positions where the cementite solid-dissolves and where ferrite preexists, being accompanied by homogenization of carbon (this is one example of the cases where cementite is easily solid-dissolved in the austenite by rapid induction heating).

If the alloy element is added in a larger amount to the steel (the point H) and therefore a larger amount of the alloy element is condensed in the cermentite (the point J), the carbon activity (the point K) of the austenite, which is in equilibrium with the cementite when only carbon solid-dissolves, leaving the alloy element M in situ, becomes lower than the carbon activity of the original composition indicated by the point A. It is understood from this fact that although carbon diffuses within a very short time in accordance with the iso-carbon-activity line passing through point K, the solid dissolving proceeds to a higher degree and that unless the alloy element M diffuses from the point K to the point B in accordance with the solid solubility line of the cementite, the cementite cannot completely solid-dissolves. Specifically, the solid dissolving of the cementite slows down rapidly while its rate being controlled by the diffusion of the alloy element M. It is further understood that complete solid-dissolving of the cementite is delayed as the difference between the alloy element concentration of the intersection point B of the iso-carbon-activity line passing through the original composition point C and the cementite solid solubility line and the alloy element concentration of the cementite increases and that the cementite is easily dispersed by induction heating and quenching. It is obvious that the solid soluble carbon concentration of the martensite parent phase can be controlled by the carbon concentration of the prior ferrite of a specified point having the M concentration, the specified point being on the iso-carbon-activity line which passes through the point K and is dependent on the CM concentration of the cementite. The distance at which the alloy element disperses when the steel material is heated at 1000° C. for 2 seconds is about 0.03 μm whereas the distance at which carbon disperses under the same condition is 12 μm. Since the dispersing distance of the alloy element is approximately 12% of the radius of cementite particles having a diameter of 0.5 μm, cementite remains in compliance with the above mechanism described earlier and carbon sufficiently disperses in the austenite parent phase so that a martensite parent phase having high hardness will be formed after rapid cooling.

In the invention, induction heating followed by rapid cooling is carried out, in which the time taken for solid dissolving of cementite in the austenite (γ phase) during induction heating from its A1 temperature to a quenching temperature of 900 to 1050° C. is controlled to be within 10 seconds. With this, the carbon concentration of the martensite parent phase wherein cementite is dispersed in a non solid-dissolving state becomes equal to the carbon concentration equivalent to the iso-carbon activity that passes the point K dependent of carbon diffusion, as discussed earlier, and according to this, a martensite hardness is obtained. However, the hardenability of the γ phase serving as the parent phase is substantially dependent of the alloy element concentration of the prior ferrite and the carbon concentration of the γ phase and is much lower than the hardenability (DI value) calculated from the amount of the alloy element added to the steel material. By applying this principle to manufacture of a gear, a quench hardened layer can be easily-formed so as to extend along the teeth profile and compressive residual stress is generated along the teeth profile to prevent quench crack. As a result, a gear further improved in the bending fatigue strength of the roots and bottoms of the teeth has been developed. It is also obvious that the dropping rate of hardenability increases as the alloy element concentration of the cementite of the structure before quenching increases. Addition of alloy elements (e.g., Cr, Mn and Mo) which are more easily concentrated in cementite is more likely to cause a significant drop in hardenability.

For concrete explanation, there will be discussed a case where rapid heating to 1000° C. is carried out followed by quenching, with reference to the Fe—C—Cr ternary phase diagram and iso-carbon activity graph (at 1000° C.) of FIG. 2.

(1) A case where cementite rapidly solid-dissolves (i.e., where the Cr concentration of cementite is low)

If the steel indicated by the point A (0.8 wt % C and 0.4 wt % Cr) of FIG. 2 is sufficiently heated at 700° C. that is within the region where cementite and ferrite coexist, it will have the compositions indicated by the point B (cementite: 2.6 wt % Cr) and the point C (ferrite: 0.09 wt % Cr). If the steel is rapidly heated from the above condition, for example, by induction heating to 1000° C. at which it comes into an austenitic state, the compositions indicated by the points B and C will be homogenized, approaching to the point A. However, whereas the alloy element contained in the cementite of the point B hardly diffuses within the austenite, carbon rapidly diffuses in the austenite (point C) in which carbon has the ferrite composition, after passing through the point D as indicated by arrows (↑ ↓). After the cementite is solid-dissolved, carbon is equilibrated on the iso-activity line of carbon (iso-carbon-activity line) that passes the point A and the element Cr is homogenized toward the point A by subsequent heating, so that more rapid solid dissolving of the cementite can be accomplished. Further, the carbon concentration of the martensite parent phase becomes substantially equal to the carbon concentration of the point A, so that harder martensite can be obtained.

(2) A case 1 where solid dissolving of cementite is significantly delayed

If the steel indicated by the point E (0.8 wt % C, 1 wt % Cr) of FIG. 2 is sufficiently heated at 700° C. that is within the region where cementite and ferrite coexist, the steel will have the compositions indicated by the point G (ferrite: 0.24 wt % Cr) and the point F (cementite: 6.61 wt % Cr). If the steel is rapidly heated from this condition, for example, by induction heating to 1000° C. at which it comes into an austenitic state, the point F will solid-dissolve, approaching to the point H similarly to the foregoing case. However, since the carbon activity of the composition indicated by the point H (the austenitic interface having carbon activity equivalent to that of the cementite when it solid-dissolves) becomes lower than that of the previous composition indicated by the point E, the cementite first solid-dissolves to the point H at high speed in accordance with the diffusion rate controlling mechanism of carbon. Thereafter, further heating is done for a long time, whereby the γ phase composition (the point H) in equilibrium with the cementite causes the cementite to solid-dissolve along the cementite solid solubility line, while Cr diffuses at the point I on the solid solubility line of the cementite. It should be noted the carbon activity of the point I is equivalent to the carbon activity of the point E. When the austenite (γ) composition has reached the point I, the cementite completely solid-dissolves. Therefore, it is understood that the carbon concentration of the martensite parent phase after short-time heating and quenching becomes equal to the carbon concentration (about 0.6 wt %) corresponding to the Cr concentration (0.24 wt %) that is substantially the same as that of the point G on the iso-carbon-activity line passing through the point H, so that about 3% by volume cementite is dispersed in a non solid dissolving condition in very hard martensite.

(3) A case 2 where solid dissolving of cementite is significantly delayed

In the case (2), the point H is established on assumption that $Cr_7C_3$ carbide differing from cementite is in equilibrium with austenite (γ phase) and a two-phase equilibrium between nonequilibrium cementite and austenite (γ phase) is possible in the process of solid dissolving of cementite. In the solid dissolving process of cementite, cementite solid-dissolves at the rate controlled by carbon diffusion up to the iso-carbon-activity line (about 0.2) that passes through the point J on the $Cr_7C_3$ carbide solid solubility line. After that, the solid dissolving of the cementite is further delayed because a restraint is imposed on the austenite (γ phase) interface composition in order to eliminate the need for formation of $Cr_7C_3$ carbide before disappearance of the cementite, the restraint being such that the steel should reach the point K of a three phase (austenite (γphase)+cementite+$Cr_7C_3$) coexisting region at which at least $Cr_7C_3$ carbide does not need to precipitate. In this case, the carbon concentration of the martensite parent phase obtained by induction heating and quenching is about 0.45 wt % and about 5% by volume cementite is dispersed in a non solid-dissolving condition within a hard martensite parent phase (HRC 57 to 61).

As obvious from the study described above, the critical point at which a remarkable delay occurs in the solid-dissolving of cementite is such that the Cr concentration of cementite is about 3 wt % (the point J) at a heating temperature of 1000° C. and about 2.5 wt % at a heating temperature of 900° C. For instance, the Cr concentration of the cementite of a steel containing 0.55 wt % C and 0.3 wt % Cr when heated at 700° C. is 2.6 wt % that is obtained by calculation with the following equation:

$$\text{The Cr concentration of cementite} = \alpha KCr \times \text{the Cr concentration of steel}/(1-(\text{the carbon concentration of steel}/6.67) \times (1-\alpha Kcr))$$

It is therefore understood that the lower limit of Cr is about 0.3 wt % and more preferably 0.4 wt % or more. In the above equation, αKCr is a distribution coefficient representing the condensability of Cr between the ferrite phase and cementite and defined by: distribution coefficient αKM=the M element concentration (wt%) of cementite÷the M element concentration (wt%) of ferrite. The distribution coefficients (at 700° C.) of other alloy elements are as follows.

$$\alpha KCr=28,\ \alpha KMn=10.5,\ \alpha Kv=9.0,\ \alpha KMo=7.5,\ \alpha KW=2.0,\ \alpha KNi=0.34,\ \alpha KSi,\ Al \approx 0$$

Of these alloy elements, Cr concentrates in cementite to the highest degree.

For applying the induction heating (900 to 1050° C.) and quenching technique to manufacture of a rolling element, the hardness of the martensite parent phase which has undergone tempering treatment at 140° C. or more after quenching needs to be increased to HRC 55 or more. Therefore, it is necessary to adjust the Cr concentration of cementite to 10 wt % or less in order to increase the carbon concentration of the martensite parent phase to 0.3 wt % and more preferably to 0.4 wt % or more. In the invention, it is desirable to control the Cr concentration of cementite in the range of 2.5 to 10 wt %.

If the carbon concentration of the martensite parent phase when cementite diffuses at the aforesaid rate controlled by carbon diffusion becomes about 0.9 wt % or more, the likelihood of quench crack at the time of induction heating and quenching increases. Therefore, it is preferable to adjust the carbon concentration to 0.3 to 0.8 wt %. If the amount of non solid-dissolving cementite is 2 to 15 % by volume, the carbon content of the steel material is 0.5 to 1.5 wt %.

The amount of Cr when 0.5 to 1.5 wt % carbon is added is preferably adjusted to 1.8 wt % or less. In view of economical efficiency, a preferable amount of Cr is 1.5 wt % or less. Where the invention is applied to a steel material for gears as described later, a preferable amount of Cr is 1.0 wt % or less with the intension of restricting hardenability.

V, Cr, Mo and W, which have higher affinity with respect to carbon and higher distribution coefficients αKM between ferrite and cementite, can significantly concentrate in cementite, and $Fe_{21}Mo_2C_6$, $V_4C_3$ and WC special carbides exist like the case of $Cr_7C_3$ carbide which has been described earlier in conjunction with Column (3). Therefore, these alloy element have been studied like the case of $Cr_7C_3$ carbide, and it has been found that the V, Mo, W concentrations of cementite need to be adjusted to 0.3 wt %, 1 wt % and 1 wt % or more, respectively. Since addition of 0.1 wt % or more V, 0.3 wt % or more Mo and 0.5 wt % or more W causes a delay in the solid dissolving of cementite, it is thought to be desirable for the invention that at least 0.3 wt % or more Cr and/or 0.1 wt % or more V be added and that Mo and W be added in combination if necessary.

As discussed earlier, if the amount of V exceeds 0.3 wt %, $V_4C_3$ carbide remains in the martensite parent phase after the induction hardening. Further, $V_4C_3$ exerts the above-described remarkable hard particle dispersion effect. For these reasons, the amount of V is preferably within the range of 0.1 to 2.0 wt %.

It is known that Mo, V and W can solid-dissolve in cementite up to about 2 wt %, about 0.6 wt % and about 1.5 wt %, respectively. In the case where Mo=1 wt % or less, V=0.3 wt % or less and W=1 wt % or less, these alloy elements participate in retarding the solid-dissolving of cementite which has been explained in the column (2) and therefore, the amounts of Mo, V, W should be determined in conjunction with the function of Cr explained in the column (2). Accordingly, it is obviously preferable that the (Cr+V+Mo+W) concentration of cementite be adjusted to 2.5 to 10 wt %.

Mn has a larger distribution coefficient αKMn than V and Mo and concentrates to a remarkable extent in cementite, but does not cause a special carbide in the austenite state. Usually, steel contains up to 1.5 wt % Mn (which means cementite contains up to 8.5 wt % Mn). With this amount, Mn does not have the effect (described in the column (2)) of retarding the solid dissolving of cementite. Therefore, a proper amount of Mn is 1.5 wt % or less.

The distribution coefficient a KM between cementite and ferrite is based on steel sufficiently heated at 700° C. as noted earlier. If heating temperature is lowered to 600° C., the distribution coefficient becomes larger. Cr, Mn, V and Mo more actively concentrate in cementite. However, if heating time is too short, they do not sufficiently concentrate in cementite; Therefore, it is apparently advisable to pre-heat the steel at a temperature equal to or lower than the eutectoid temperature of the steel.

In addition, dispersion of plate-like cementite having a pearlite structure or coarse cementite particles within the martensite parent phase of the rolling contact surface layer is apparently undesirable in view of strength. Therefore, it is advisable to form cementite into fine grains having an average particle diameter of 1 μm or less as a pretreatment of the induction hardening. In the pretreatment for fining cementite particles, addition of an element having a large distribution coefficient αKM is necessary and therefore it is preferable to add Cr which concentrate in cementite to the highest degree.

The above concentration of an alloy element in cementite is done by applying a heat treatment to the two phase (ferrite+cementite) structure. It is also possible to cause an alloy element to concentrate in cementite by heating the two phase (austenite+cementite) structure at a temperature equal to or higher than the A1 temperature. Therefore, it is apparent that the amount of an alloy element concentrated in cementite can be adjusted by use of, for example, γKM (the distribution coefficient between the cementite/austenite of an alloy element M (e.g., γKCr=8.5, γKV=13, γKMo=4.2, γKMn=2.4 )) at 800° C. defined by the following equation.

The alloy element M concentration of cementite÷The alloy element M concentration of austenite=γKM In the area around the cementite which has been dissolved at the time of the short-time rapid heating and the area around the undissolved cementite, C, Mn, Cr and Mo, which significantly lower Ms temperature, concentrate as understood from the iso-carbon-activity lines of FIGS. 1 and 2. Therefore, a retained austenite phase is likely to be formed in these areas. This is favorable because the toughness of the rolling contact surface layer where the aforesaid special carbides, nitrides, carbonitrides and cementite disperse, increasing the possibility of internal notches can be restored and its contact fatigue strength is improved. Therefore, in the invention, the amount of the retained austenite phase is adjusted within the range of 10 to 50% by volume.

The lower limit of the amount of retained austenite is determined taking account of the amount of retained austenite phase formed by the conventional carburizing/quenching process. The upper limit of the amount of retained austenite is determined to be 50% by volume because it is well known that the wear resistance of steel significantly drops when the amount of retained austenite phase is more than 50% by volume.

In cases where the structure before the induction hardening is a spheroidal cementite structure, it is necessary to once form deep martensite in order to carry out spheroidizing through refining of a raw material (quenching/tempering thermal treatment). This inevitably gives rise to a need for use of a steel having high hardenability, but it is desirable for the invention to employ a spheroidizing/annealing treatment. With this treatment, the time taken for the thermal treatment can be markedly reduced particularly when Si and Al which significantly increase eutectoid temperature are added to the steel in large amounts. When producing a rolling element by the induction hardening, homogenization by heating usually takes several seconds. If the induction hardening is carried out with Cr, Mo, V, Mn or the like concentrated in the cementite as described earlier, homogenization of the alloy elements hardly proceeds within the martensite parent phase so that the temper softening resistance of the martensite parent phase decreases and the dispersion effect of the cementite particles upon the strength of the rolling contact surface is not sufficiently exerted. Therefore, there is a possibility that the contact fatigue strength of the rolling element will not be improved compared to carburized, quenched rolling elements. To solve this problem, the invention uses a steel material containing at least Si and/or Al which hardly concentrates in cementite and efficiently remains in the martensite parent phase, thereby increasing the temper softening resistance of the martensite parent phase. More specifically, the invention uses a steel material containing at least 0.5 to 3.0 wt % Si, 0.20 to 1.5 wt % Al or 0.5 to 3.0 wt % (Si+Al), and further containing one or more alloy elements selected from V, Ti, Zr, Nb, Ta, Hf, Mn, Ni, Cr, Mo, Cu, W, B, and Ca, unavoidable impurity elements such as P, S, N and O, and balance substantially consisting of Fe. The rolling contact surface layer made of this steel material is preferably subjected to quenching or induction hardening and then to tempering at 300° C. or less so that the resulting quench-hardened layer has a hardness of HRC 50 or more after tempering at 300° C. In addition, the steel material is preferably prepared so as to satisfy the relationship described by:

$$5 \leqq 4.3\times Si\ (wt\ \%)+7.3\times Al\ (wt\ \%)+3.1\times V\ (wt\ \%)+1.5\times Mo\ (wt\ \%)+1.2\times Cr\ (wt\ \%)\times(0.45+C\ (wt\ \%)).$$

The hardness of the aforesaid S55C carbon steel after tempering at 300° C. is HRC47. If the above-described hard particles are dispersed within the martensite parent phase of this steel, contact fatigue strength substantially equal to that of carburized, quenched gears can be attained. Taking this into account, the invention is designed such that the martensite parent phase has a hardness of HRC 50 or more after tempering at 300° C., but the hardness of a rolling element having higher contact fatigue strength is preferably HRC 53 or more.

In the invention, ferrite stabilizing elements such as Si and Al are added in large amounts and therefore the risk of remaining a ferrite phase in the quench-hardened layer during the induction hardening should be taken into account. However, it can be seen from FIG. 3 that austenite can be satisfactorily formed at a heating temperature of 900 to 1050° C. during the induction hardening by setting the carbon content of a steel containing 3 wt % Si to 0.35 wt % or more and more preferably to 0.45 wt % or more. If Al is added in place of Si in the invention, the upper limit of the amount of Al is preferably set to 1.5 wt %, because Al exerts ferrite stabilizing ability twice or more that of Si.

Even if the structure before the induction hardening is a (ferrite+pearlite) structure, homogenization by short-time induction heating is difficult in cases where coarse ferrite exists. It is therefore advisable to take the following measures: the steel material contains the carbides and carbonitrides of Ti, V, Zr, Nb, Ta and Hf; the (ferrite+pearlite) structure is fined; generation of coarse ferrite is restricted; and the carbon content of the steel is adjusted to 0.6 wt % or more.

Since Cr, Mn and Mo significantly enhances the hardenability of steel, increasing a possibility that quench crack occurs in steel having high carbon concentration during induction hardening, it is advisable to carry out induction hardening in such a way that Cr, Mn and Mo are allowed to fully concentrate in the cementite by heating the steel at a temperature ranging from the A1 temperature (eutectoid transformation temperature) to 550° C. and the cementite is allowed to remain to markedly reduce the hardenability of the austenite. Above all, Mn most effectively increases the hardenability of steel. Condensation of Mn in the residual cementite by Cr addition as described earlier is beneficial for "contour quenching" in which the contour of the teeth of a gear is quench-hardened by an induction heating and quenching process, because it has the effect of reducing the hardenability of the austenite in the induction hardening. It is apparently preferable to limit the amount of Mn added to the steel to 0.2 to 0.5 wt %. Preferably, the steel material used for producing the rolling element of the invention at least contains 0.3 to 1.5 wt % Cr and/or 0.1 to 0.3 wt % V and further contains one or more element selected from 0.2 to 0.5 wt % Mn, 0.5 wt % or less Mo and 0.5 wt % or less W.

According to the invention, there has been developed a rolling element having high contact fatigue strength, wherein one or more compounds selected from the nitrides and carbonitrides of V, Ti, Zr, Nb, Ta and Hf and having an average particle diameter of 0.2 μm or less are additionally precipitately dispersed on a rolling contact surface layer by carburizing, carbonitriding or nitriding, the rolling contact surface layer originally containing one or more compounds selected from the carbides, nitrides and carbonitrides of V, Ti, Zr, Nb, Ta and Hf and having an average particle diameter of 0.2 to 5 μm, and cementite particles having an average particle diameter of 1.5 μm or less, these compounds and cementite being dispersed in the rolling contact surface layer, wherein the carbon content of the rolling contact surface layer is adjusted to 0.65 to 1.5 wt % and/or the nitrogen content of the rolling contact surface layer is adjusted to 0.1 to 0.7 wt %.

In the above case where carburizing, carbonitriding or nitriding is preliminarily applied to a steel in which one or more compounds selected from the carbides, nitrides and carbonitrides of V, Ti, Zr, Nb, Ta and Hf and having an average particle diameter of 0.2 to 5 μm are dispersed, V, Ti, Zr, Nb, Ta and Hf which solid-dissolve in the matrix precipitate in the form of finer nitrides and carbonitrides. The originally dispersing carbides transform into carbonitrides and partially solid-dissolve again, finely precipitating as more stable carbonitride particles having a size of 0.2 μm or less. As a result, the seizure resistance of the rolling contact surface layer is dramatically improved while its contact fatigue strength being improved.

The depth of the layer into which the extremely fine carbides, nitrides and/or carbonitrides are additionally dispersed by carburizing, carbonitriding or nitridirig is preferably in the range of 100 μm or less in view of economical efficiency, taking account of the facts that the dispersion of the above compounds has the effect of improving the seizure resistance of the sliding contact surface, that temper softening intensively occurs at the outermost surface of the rolling contact surface layer, and that the wear life of the rolling contact surface of gears or the like is in the range of up to 100 μm. Although the invention is associated with development of an inexpensive rolling element in which the induction hardening is employed as a process of quenching a rolling contact surface layer, the following technique may be applied to carburizing/quenching and carbonitriding/quenching. Specifically, one or more compounds selected from the carbides, nitrides and carbonitrides of V, Ti, Zr, Nb, Ta and Hf and having an average particle diameter of 0.2 to 5 μm are dispersed beforehand, and one or more compounds selected from the carbides, nitrides and carbonitrides of V, Ti, Zr, Nb, Ta and Hf and having an average particle diameter of 0.2 μm or less are additionally precipitately dispersed by carburizing, carbonitriding or nitriding in the rolling contact surface layer containing cementite particles of 1 μm or less dispersed therein in order to improve the contact fatigue strength of the rolling contact surface layer. However, it is more advisable to apply the above-described induction hardening treatment after carburizing or carbonitriding, thereby achieving an improvement in toughness and others through the dispersion of the fine cementite particles, the impartment of a great compressive residual stress, the pulverization of prior austenite grains and the adjustment of the soluble carbon concentration of the martensite parent phase.

In cases where the technique for reinforcing the rolling contact surface layer by the induction hardening after carburizing, carbonitriding or nitriding is employed, it is apparently desirable for manufacture of a gear to use a steel material at least containing 0.2 to 0.8 wt % C; further containing either 0.5 to 3.0 wt % Si or 0.2 to 1.5 wt % Al or alternatively, 0.5 to 3.0 wt % (Si+Al); and further containing one or more alloy elements selected from the group consisting of Mn, Ni, Cr, Mo, V, Cu, W, Ti, Nb, B, Zr, Ta, Hf, and Ca, unavoidable impurity elements such as P, S, N and O, and balance essentially consisting of Fe, when taking account of the cost performance of mechanical processing, the formation of a quench-hardened layer so as to fit the teeth profile after the induction hardening, more effective generation of a great compressive residual stress, the dispersion of fine cementite particles, and the pulverization of prior austenite grains.

In the steel material used for producing a rolling element by carburizing or carbonitriding, the amount of carbon after deduction of the amount necessary for dispersing V, Ti, Zr, Nb, Ta and Hf as carbides beforehand is adjusted to 0.1 to 0.3 wt %. If a large amount of Si is added, a ferrite phase is likely to remain in an area inner than the carburized or carbonitrided layer at the time of the induction hardening, which gives rise to a possibility that martensite having satisfactory strength will not be formed. Therefore, Mn and Ni which stabilize the austenite phase are added in an amount of 1.0 to 2.5 wt % in total, thereby lowering quenching temperature. Further, 0.5 to 1.5 wt % Cr is added for dispersing the cementite, and 0.35 wt % or less Mo and 0.0005 to 0.005 wt % B are added for enhancing hardenability.

In the invention, a remarkable toughness increasing effect is achieved by coexistence of the above amount of Al and 0.3 to 1.5 wt % Ni. This has been already reported in Japanese Patent Application No. 2002-135274. Addition of Al and Ni brings good Charpy impact properties even in a high-hardness maretensitic structure containing 0.6 wt % or 1.2 wt % carbon and therefore they are regarded as useful gear materials capable of dramatically improving the impact load resistance of gears. Since Ni addition increases the cost of the steel material, the amount of Ni is set to 1.5 wt % or less.

Where the rolling element is a gear produced by carburizing/quenching, carbonitriding/quenching or induction hardening after carburizing or carbonitriding, it is apparently advisable to apply mechanical treatment such as shot peening, thereby allowing a compressive residual stress of at least 50 kgf/mm$^2$ to remain at the tooth roots in order to restrict decreases in the bending strength of the tooth roots due to the inner part notching action of the above carbides, nitrides and/or carbonitrides and cementite.

Next, the functions of the alloy elements employed in the invention will be collectively described below.

V, Ti, Zr, Nb, Ta, Hf: 0.2 to 2.0 wt %

The above alloy elements react to carbon and nitrogen contained in the steel, forming MC-type carbides, nitrides and M(CN)-type carbonitrides. Since the solid solubility of these alloy elements with respect to steel is extremely low, they easily finely precipitate and disperse in the steel at the stage of steelmaking. These alloy elements are very hard (Vickers hardness=1500 or more) and have excellent thermal and chemical stability compared to the quench-hardened layer of steel. Therefore, dispersion of trace amounts of these alloy elements leads to improved resistance to seizure that occurs during sliding of the rolling element, as apparent from the fact that tools containing these alloy elements and exposed to extremely high temperature (e.g., cemented carbide and cermet) exhibit good wear resistance and seizure resistance. However, where these alloy elements are dispersed in large amounts, the friction coefficient during sliding increases, presenting the problems of decreased seizure resistance and an increased probability of attacking the mating member. For this reason, the dispersion amount of these alloy elements are properly limited to a range of 0.4 to 4% by volume thereby achieving improved seizure resistance in the invention.

Of the above alloy elements, $V_4C_3$ carbide has relatively great solid solubility with respect to austenite and solid-dissolves in an amount equivalent to 0.3 wt % V, depending on the condition of the induction heating. Therefore, a preferable amount of V is 0.4 to 2 wt %. However, addition of 0.1 wt % or more V retards the solid-dissolving of the cementite caused by the induction heating so that cementite particles effectively remain in the rolling contact surface layer. In view of this, the lower limit of the amount of V is set to 0.1 wt %. V has the function of providing increased softening resistance in low temperature tempering as described earlier and exhibits more remarkable softening resistance than Si and Al during high temperature tempering. In view of this, it is preferable to positively add 0.2 wt % or more V.

It is extremely beneficial that even if overheating occurs in the heating phase of the induction hardening, the austenite grains can be prevented from coarsening by dispersing the carbides, nitrides and/or carbonitrides in the austenite.

Si: 0.5 to 3.0 wt %

Si is an element capable of markedly increasing the temper softening resistance in lower temperature tempering at 350° C. or less. The mechanism of increasing the temper softening resistance is such that $\epsilon$ carbide which precipitates at lower temperatures is more stabilized and softening is prevented by raising cementite precipitation to a higher temperature region.

The lower limits of the amounts of Si and Al are determined in consideration of the following facts. Since the softening resistance ΔHRC of Si per gram in tempering at 300° C. is 4.3 and the base hardness in tempering at 300° C. obtained from 0.55 wt % carbon is HRC 47.6, the amount of Si for ensuring a hardness of HRC 50 in tempering at 300° C. is about 0.5 wt %. The amount of Al in the presence of 0.15 wt % Si is about 0.25 wt % since the softening resistance ΔHRC of Al is 7.3.

The upper limit of the amount of Si is set to 3.0 wt % in order that the Ac3 transformation temperature does not exceed 900° C. when the soluble carbon content of the martensite parent phase is in the range of 0.3 to 0.8 wt % and induction hardening temperature does not increase needlessly. Where oil quenching is carried out after carburizing or carbonitriding, the carbon content of the steel material needs to be 0.2 to 0.8 wt %. In view of this, it is apparently preferable to restrict the upper limit of Si to 2 wt % in order to avoid excessively increased quenching temperature.

Al: 0.25 to 1.5 wt %

Al can be suitably used for cleaning steel material because it exerts a strong deoxidization action and actively eliminates P and S contained in steel as impurities from the crystal grain boundary. In the invention, after confirming that Al is an element for increasing low temperature temper softening resistance more effectively than Si (ΔHRC=7.3), the amount of Al is determined to be 0.25 to 1.5 wt % where Al is added alone. Where part of Si is replaced with 0.15 to 1.5 wt % Al, the amount of (Si+Al) is set to 0.5 to 3.0 wt %. As noted earlier, Al is a stronger ferrite stabilizer than Si and raises the Ac3 temperature about 1.6 times higher than Si does. For this reason, the maximum amount of Al is set to 1.5 wt % (2.5 wt %/1.6). If oil quenching or the induction hardening is carried out after carburizing or carbonitriding, the carbon content of the steel material needs to be 0.2 to 0.8 wt %. Therefore, it is definitely preferable to restrict the upper limit of Al to 1 wt % lest quenching temperature excessively increases.

Ni:

It has been already reported in Japanese Patent Application No. 2002-240967 that remarkable toughness can be achieved by adding 0.3 to 2.5 wt % Ni in the presence of the above amount of Al. Above all, high-hardness martensitic structures containing 0.6 wt % or 1.2 wt % carbon possess excellent Charpy impact properties and Ni can dramatically improve the impact load resistance of gears. Therefore, Ni is useful as a gear material. However, Ni addition increases the cost of the steel material and therefore the amount of Ni is set to 1.5 wt % or less in the invention. Ni also stabilizes austenite and Ni addition lowers quenching temperature when Si and Al coexist with Ni. In the case of a rolling element whose rolling contact surface layer is hardened by carburizing quenching or carbonitriding quenching, it is preferable to use Ni in combination with Mn. A rough standard for the amount of (Mn+Ni) is 2.5 wt %, where Si is added in its maximum amount (3 wt %) for instance.

Cr:

Cr is an element capable of markedly increasing the hardenability of steel. Where the tooth flanks of a gear are quench-hardened by induction hardening, only the surface layer portion which has been heated to a temperature equal to or higher than the Ac3 transformation temperature by the induction heating may be rapidly cooled. Therefore, the hardenability (DI value) of a gear material does not need to be higher than the hardenability (DI value: 2.0 inches or more) of ordinary carbon steels. Where no cementite is dispersed in a steel material for gears as discussed earlier, the amount of Cr is often adjusted to 0.5 wt % or less in order to reduce the possibility of quench crack. Where cementite is dispersed by the above induction hardening technique, it is preferable to add 0.3 to 1.5 wt % Cr for the purpose of fining the cementite. In this case, it is preferable that Cr be allowed to sufficiently concentrate in the cementite by spheroidizing the cementite and the solid dissolving of the alloy element in the austenite formed during the induction heating be restricted thereby substantially limiting the hardenability of the austenite to restrain the possibility of occurrence of quench crack. It is also desirable to promote the dispersion of the cementite by addition of V which scarcely affects the hardenability of the steel thereby limiting the amount of Cr to 0.5 wt % or less. In the case of the above rolling element which has undergone oil quenching after carburizing or carbonitriding, the amount of Cr is preferably 1.5 wt % or less in order to ensure hardenability.

Mn:

Mn is an element capable of not only exerting remarkable desulfurization but also stabilizing austenite as noted earlier. Mn is also useful as it increases the hardenability of steel. Therefore, it is used in proper amounts according to need. In a rolling element in which the soluble carbon content of the martensite parent phase is 0.3 to 0.8 wt %, the austenite is satisfactorily stabilized by carbon. In view of this, the lower limit of the amount of Mn is 0.2 wt %. In a rolling element whose rolling contact surface layer is induction hardened after carburizing or carbonitriding, the austenite cannot be sufficiently stabilized because of a small amount of carbon and therefore Si is added in its maximum amount (3 wt %) for stabilizing the ferrite. In such a case, it is advisable to add Mn, which is an inexpensive element, in an amount of up to about 2 wt %, or Mn in combination with Ni in a total amount of about 2.5 wt %.

Mo:

Mo is a useful element as it increases the hardenability of steel and restrains temper brittleness, and therefore it is desirable for the invention to add Mo in an amount of 0.35 wt % or less which is the same level as that of the ordinary case-hardened SCM steel. If 0.3 wt % Mo is added to a rolling element to which the above-described induction hardening technique is applied, the solid dissolving of the cementite into the austenite during the induction heating phase will be retarded. However, when considering the role and economical efficiency of Mo, it is obvious that Mo is not an indispensable alloy element and W is substantially similar to Mo in this respect.

According to the invention, there is provided a method of producing a rolling element from a steel material which contains at least 0.5 to 1.5 wt % carbon; 0.3 to 1.5 wt % Cr; and 0.2 to 2.0 wt % one or more alloy elements selected from V, Ti, Zr, Nb, Ta and Hf; and in which 0.4 to 4.0 % by volume one or more of carbides, nitrides and carbonitrides of the above alloy elements having an average particle diameter of 0.2 to 5 μm and 7.5 to 20 % by volume cementite are dispersed, wherein the soluble carbon concentration of a martensite parent phase of a rolling contact surface layer, which has been subjected to induction heating quenching and low temperature tempering, is adjusted to 0.3 to 0.8 wt % and wherein 0.4 to 4.0% by volume one or more of the carbides, nitrides and carbonitrides and 2 to 15% by volume cementite are dispersed within the martensite parent phase.

Preferably, the invention is arranged such that, by use of a steel material in which the Cr concentration of the cementite has been adjusted to 2.5 to 10 wt % and which has been subjected to a thermal treatment for spheroidizing the cementite, the soluble carbon concentration of the martensite parent phase is adjusted to 0.35 to 0.8 wt %, 2 to 15 % by volume granular cementite having an average particle diameter of 1.5 μm or less is dispersed in the parent phase, and 10 to 50% by volume retained austenite is formed.

Preferably, the induction heating/quenching of the rolling contact surface layer of the invention is performed such that rapid cooling is carried out subsequently to rapid heating in which the temperature of the steel material is raised from the A1 temperature to a quenching temperature of 900 to 1050° C. within 10 seconds.

In the induction heating/quenching of the invention, an induction-hardened-contour gear having a quench hardened layer formed along the teeth profile is produced by setting at least the speed of heating from the A1 temperature to the above quenching temperature to 150° C./sec or more.

According to the invention, there is provided a method of producing a rolling element from a steel material which contains at least 0.2 to 0.8 wt % carbon; 0.5 to 1.5 wt % Cr; and 0.2 to 2.0 wt % one or more alloy elements selected from V, Ti, Zr, Nb, Ta and Hf; and in which 0.4 to 4.0 % by volume one or more of carbides, nitrides and carbonitrides of the above alloy elements having an average particle diameter of 0.2 to 5 μm are dispersed, wherein a carburizing, carbonitriding or nitriding treatment is applied to a rolling contact surface layer so that one or more compounds selected from nitrides and carbonitrides of V, Ti, Zr, Nb, Ta and Hf having an average particle diameter of 0.2 μm or less are additionally precipitately dispersed and so that the carbon content of the rolling contact surface is adjusted to 0.65 to 1.5 wt % and/or the nitrogen content of the rolling contact surface is adjusted to 0.1 to 0.7 wt %, while 7.5 to 20% by volume cementite being dispersed, and wherein induction heating/quenching and low-temperature tempering are further applied to the rolling contact surface layer so that the soluble carbon concentration of a martensite parent phase of the rolling contact surface layer is adjusted to 0.35 to 0.8 wt %, and 0.4 to 4.0% by volume one or more of the carbides, nitrides and carbonitrides and 2 to.15% by volume cementite are dispersed in the parent phase.

In the invention, mechanical treatment such as shot peening may be applied in order to increase the compressive residual stress of the rolling contact surface layer.

In cases where the tooth flanks of a gear are quench-hardened by the induction hardening technique, only the surface layer which has been heated to a temperature equal to or higher than the Ac3 transformation temperature by induction heating may be quench-hardened, and therefore the gear material does not need to have hardenability (DI value) higher than the hardenability (2.0 inches or more) of the ordinary carbon steel level. This means that inexpensive steel materials can be used. Therefore, it is more preferable for the invention that, the amounts of Mn and Cr be reduced and the amounts of alloy elements such as Si, Al, Ni, Mo and V be controlled to obtain a DI value of 2.0 inches or less.

In the induction hardening process using the above-described steel material, rapid cooling is carried out subsequently to rapid induction heating in which the temperature of the steel material is raised from room temperature or a preheated state (the A1 temperature or less) to a quenching temperature of 850 to 1100° C. within 10 seconds, whereby at least the rolling contact surface layer is quench-hardened. As described later, the hardness of the quench-hardened layer, the residual amount of cementite and the soluble carbon content of the martensite phase were checked when SUJ2 (1.01 wt % C-1.5 wt % Cr, Hv=200) which had been sufficiently spheroidized was heated to each quenching temperature at a heating speed of 6° C./sec and then rapidly cooled. It is understood from the result of the check that a structure in which 5% by volume or more cementite is densely dispersed within a sufficiently hard martensite parent phase could be formed. In this case, a proper heating temperature is 900 to 1000° C.. If a Cr concentration lower than that of SUJ2 is employed, the Cr concentration of the cementite will decrease and the lower limit of the proper heating temperature becomes about 1100° C. It is at least assumed from the heating temperature of 6° C./sec that generation of a great compressive residual stress and formation of a quench-hardened layer along the teeth profile are difficult for the gear material of the invention. Therefore, the high-frequency (induction) heating process suited for rapid heating is employed, utilizing the internal heat generation of the rolling contact surface layer. From the conversion of the induction heating speed, it is understood that the time taken for the induction heating is preferably within 10 seconds.

It is more desirable to produce a low-strain rolling element having a quench-hardened layer formed along the teeth profile by a method wherein the rolling contact surface layer of the rolling element is preheated to a temperature in the range of 300° C. to the A1 temperature and then induction heating is rapidly carried out on a frequency of 60 kHz or less at a heating speed of 150° C./sec or more until a quenching temperature of 900 to 1000° C. is reached, and thereafter, rapid cooling is carried out. In view of economical efficiency, a more preferable induction hardening method is such that the upper limit of heating speed is 2500° C./sec and rapid heating is done within 3 seconds.

BEST MODE FOR CARRYING OUT THE INVENTION

Referring now to the accompanying drawings, rolling elements and the producing methods thereof will be hereinafter concretely described according to preferred embodiments of the invention.

EXAMPLE 1

The Pitting Resistance of Quenched, Tempered Carbon Steels and Carburized, Quenched, Case-Hardened Steels (Preliminary Test)

Figure 1:
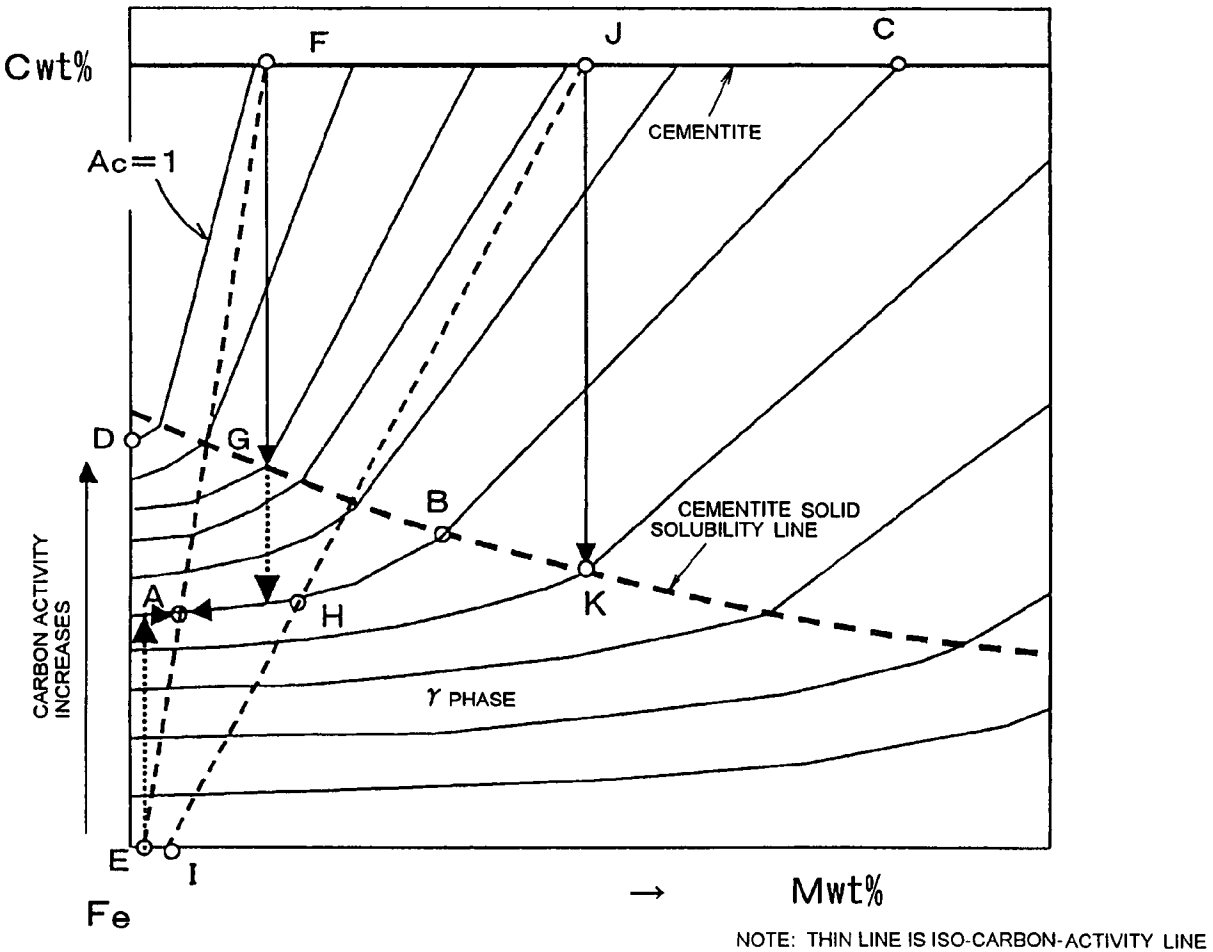
FIG. 1 is a γ phase solid dissolving mechanism diagram combined with an Fe—C-M based steel phase diagram and an iso-carbon activity graph.
Figure 2:
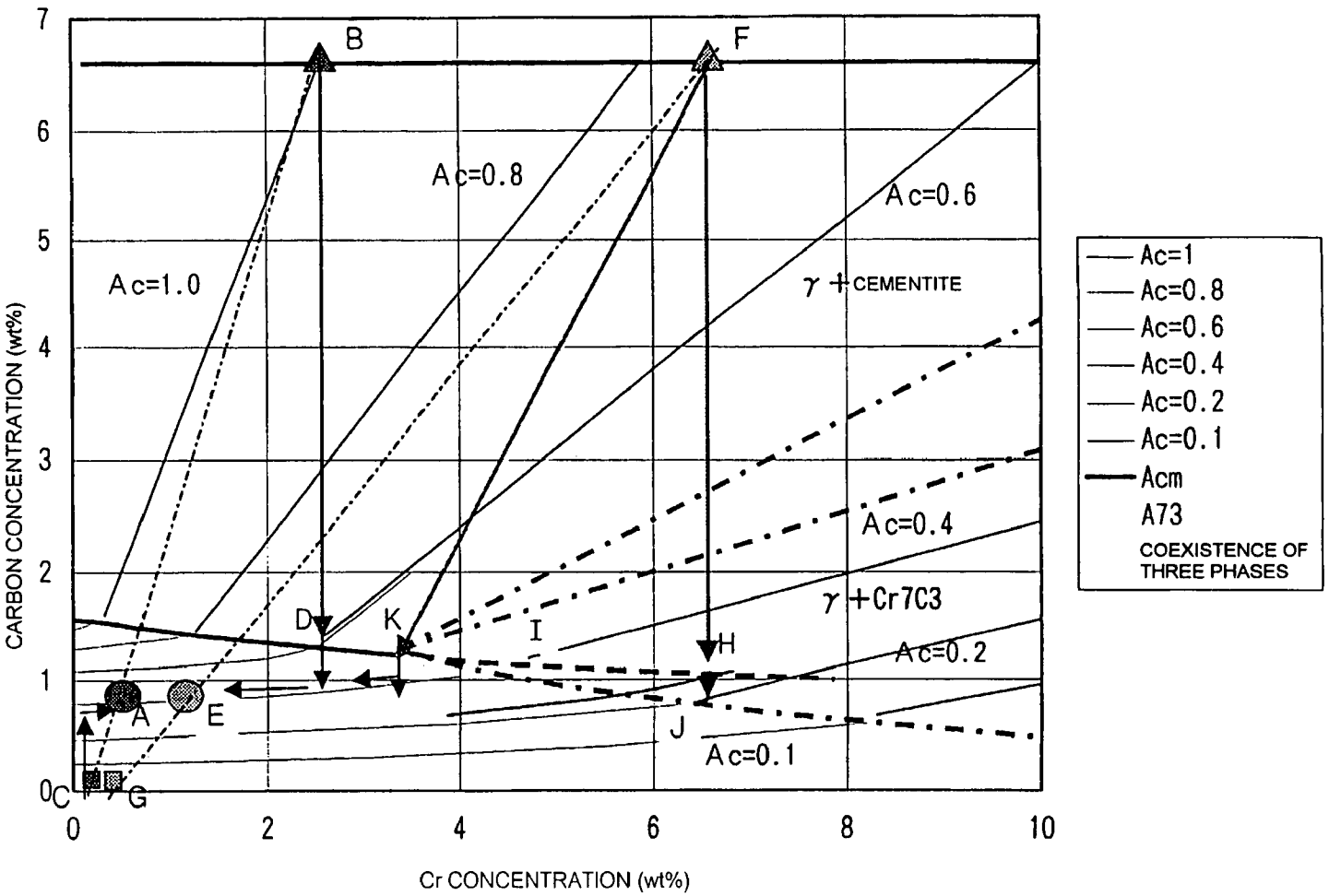
FIG. 2 is an Fe—C—Cr based steel iso-carbon activity graph (at 1000° C.).
Figure 3:
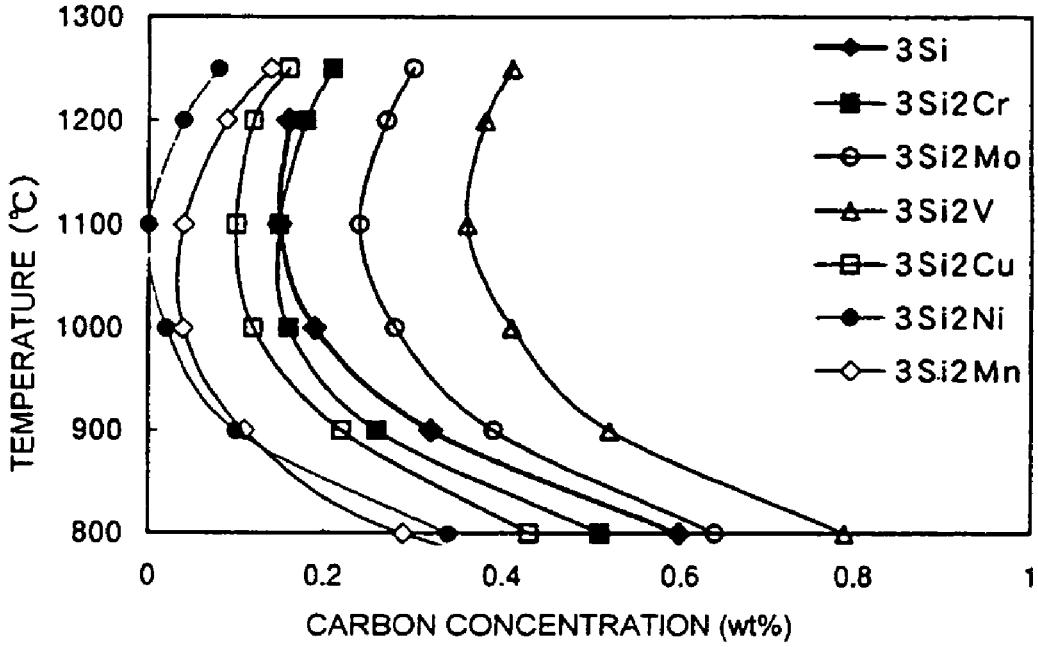
FIG. 3 is a phase diagram showing the influence of alloy elements upon Fe—3 wt % Si.
Figure 4:
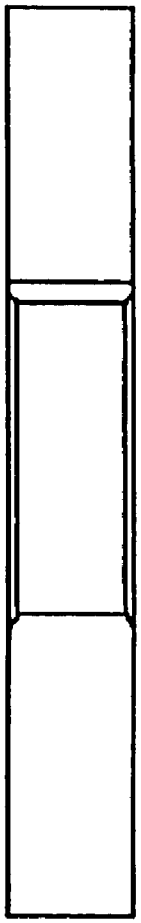
FIGS. 4(*a*), 4(*b*) are views of test specimens for use in a roller pitting test wherein FIG. 4(*a*) shows a small roller test specimen whereas FIG. 4(*b*) shows a large roller test specimen.
Figure 4:
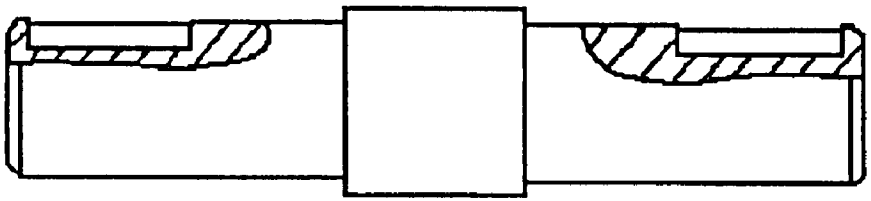

In this example, a roller pitting test was conducted using the test specimens shown in FIG. 4 and various quenched, tempered carbon steels and carburized, quenched, case-hardened steels were checked in terms of pitting resistance to investigate the rolling fatigue strength of the tooth flanks of gears under a sliding contact condition. Table 1 shows the chemical compositions of the various carbon steels and case-hardened steels used in this example. These steel materials were respectively shaped into the small rollers shown in FIG. 4(*a*) and the test specimens No. 1, 2 and 4 were further subjected to water quenching after heating at 820° C. for 30 minutes, and then tempered at 160° C. for 3 hours, followed by testing. The test specimen No. 3 was quench-hardened, at its rolling contact surface, using a 40 kHz high-frequency power source after thermal refining and then subjected to tempering as described above. No. 5 was cooled to 850° C. after carburization (carbon potential =0.8) at 930° C. for 5 hours. Then, it was kept at 850° C. for 30 minutes and quenched by a quenching oil having a temperature of 60° C., followed by the same tempering treatment as described above.

TABLE 1

| | C | Si | Mn | Ni | Cr | Mo | Note |
|---|---|---|---|---|---|---|---|
| No. 1 | 0.55 | 023 | 0.71 | | | | S55C |
| No. 2 | 0.77 | 0.21 | 0.74 | | | | Eutectoid Carbon Steel (1) |
| No. 3 | 0.85 | 0.22 | 0.81 | | 0.43 | | Eutectoid Carbon Steel (2) |
| No. 4 | 0.98 | 0.27 | 0.48 | | 1.47 | | SUJ2 |
| No. 5 | 0.19 | 0.22 | 0.75 | | 0.97 | 0.15 | SCM420H |

A large roller was prepared by applying water quenching to the SUJ2 material of No. 4 after heating at 820° C. for 30 minutes and then tempering it at 160° C. for 3 hours. The roller pitting test was carried out in such a way that the small and large (loaded) rollers were rotated at speeds of 1050 rpm and 292 rpm respectively, while being lubricated with #30 engine oil having a temperature of 70° C., and a load is imposed on the rollers with a slip ratio of 40% and interface pressures ranging from 375 to 220 kgf/mm$^2$.

Figure 5:
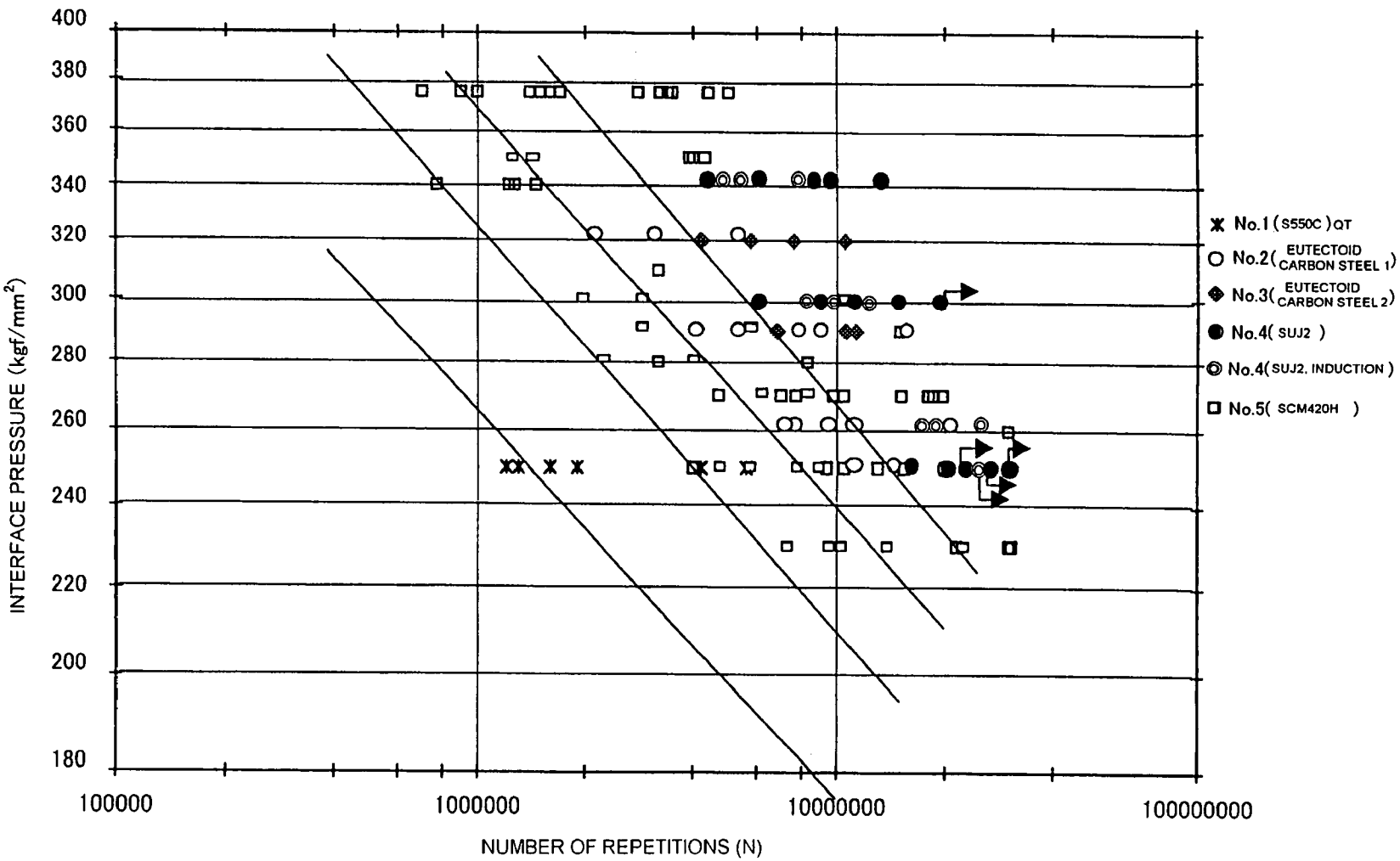
FIG. 5 is a graph showing the result of a preliminary test for checking roller pitting resistance.

FIG. 5 collectively shows the number of repetitions at which pitting occurred under each interface pressure. In FIG. 5, a lifetime line of the carburized case-hardened steel serving as a reference is indicated by solid line. This lifetime line is formed by connecting the minimum numbers of repetitions obtained when the carburized case-hardened steel was subjected to various interface pressures in the above range. On assumption that the interface pressure when the number of repetitions which causes occurrence of pitting is $10^7$ times is defined as rolling contact fatigue strength, the pitting resistance corresponding to it has been found to be about 210 kgf/mm$^2$. When the pitting resistance of each test specimen was checked in the same way, it was found that No. 1=175 kgf/mm$^2$, No. 2=240 kgf/mm$^2$, No. 3 (induction hardening) =260 kgf/mm$^2$, No. 4=270 kgf/mm$^2$ and No. 4 (induction hardening)=290 kgf/mm$^2$. It can be understood from this result that Nos. 3 and 4, in which cementite particles are dispersed in amounts of about 2% by volume and about 10% by volume, respectively, are significantly improved in rolling contact fatigue strength. Also, it can be understood that the pitting resistance of the carburized case-hardened steel varies to a somewhat large extent because of intergranular oxidation which occurred during the carburization of the rolling contact surface, the presence of a slack quenched layer, and a large amount of retained austenite. It was found from the comparison in terms of the average number of repetitions which caused pitting that the pitting strength of the carburized case-hardened steel does not differ from that of the test specimen No. 2.

The X-ray half value width of the martensite phase of the rolling contact surface of each test specimen in which pitting had occurred was checked. As a result, it was found that No. 1=3.6 to 4.0°, No. 2=4 to 4.2°, No. 3=4.2 to 4.4°, No. 4=4.3 to 4.6° and No. 5=4 to 4.2°.

Further, the test specimens Nos. 1 to 5 which had undergone the above-described thermal treatment were tempered at 250 to 350° C. for 3 hours and then, the X-ray half value width of the rolling contact surface of each test specimen in which pitting had occurred was checked. As a result, the half value width of each specimen under the above condition was found to be substantially coincident with the half value width when tempering was carried out at 300° C. This result substantially coincides with the relationship between the temper hardnesses and half value widths of carbon steels having various carbon concentrations which is reported in "Material Vol. 26, No. 280, P26".

EXAMPLE 2

Checking of Temper Softening Resistance

Table 2 shows the alloy compositions employed in this example. Thermal treatment was carried out in such a way that after heated at 810 to 870° C. for 30 minutes, each test specimen was subjected to water cooling and then tempering at 300° C. and 350° C. for 3 hours. Thereafter, the Rockwell hardness HRC of each test specimen was checked and the effect of addition of each alloy element on the hardness was analyzed.

TABLE 2

| TPNo. | C | Si | Al | Mn | Ni | Cr | Mo | V | B |
|---|---|---|---|---|---|---|---|---|---|
| No. 6 | 0.45 | 1.45 | | 0.46 | | 1.49 | 0.52 | 0.14 | 0.0018 |
| No. 7 | 0.49 | 1.45 | | 0.46 | | 1.01 | 1.03 | 0.15 | 0.0019 |
| No. 8 | 0.47 | 0.31 | | 0.46 | | 2.01 | 1.03 | 0.15 | 0.0019 |
| No. 9 | 0.49 | 0.29 | | 0.45 | | 1.5 | 1.49 | 0.23 | 0.0019 |
| No. 10 | 0.36 | 1.77 | | 0.6 | | 0.62 | 0.11 | | 0.0026 |
| No. 11 | 0.45 | 0.95 | | 0.66 | 0.01 | 1.29 | 0.5 | | 0.0029 |
| No. 12 | 0.39 | 0.93 | | 1.02 | 0.08 | 0.97 | 0.95 | 0.5 | |
| No. 13 | 0.43 | 0.26 | | 0.44 | | 1.01 | 0.48 | | 0.001 |
| No. 14 | 0.47 | 0.25 | | 0.4 | | 1.01 | 1.05 | | 0.0018 |
| No. 15 | 0.46 | 1.5 | | 0.4 | | 1 | 0.51 | | 0.002 |
| No. 16 | 0.45 | 0.24 | | 0.4 | | 1.02 | 0.48 | 0.31 | 0.0011 |
| No. 17 | 0.45 | 1.46 | | 0.39 | | 0.96 | 0.98 | | 0.001 |
| No. 18 | 0.41 | 0.25 | | 0.35 | | 1 | 0.49 | | 0.0017 |
| No. 19 | 0.52 | 2.3 | | 0.57 | | 0.11 | | | |
| No. 20 | 0.98 | 0.27 | | 0.48 | | 1.47 | | | |
| No. 21 | 0.55 | 0.23 | | 0.71 | | | | | |
| No. 22 | 0.77 | 0.21 | | 0.74 | | | | | |
| No. 23 | 0.45 | 0.21 | 1.26 | 0.53 | | 1.51 | 0.21 | | |
| No. 24 | 0.6 | 0.25 | 0.97 | 0.93 | 0.98 | 1.04 | 0.35 | | |

In a preliminary experiment, the hardness of a carbon steel containing 0.1 to 1.0 wt % carbon and 0.3 to 0.9 wt % Mn was checked and utilized as base data for the analysis of the effect of each alloy element. As a result, it was found that the hardnesses of the steel was approximated by the following equations.

$$HRC=34\times\sqrt{C}\ (wt\ \%)+26.5\ (\text{tempering temperature}=250°\ C.)$$

$$HRC=36\times\sqrt{C}\ (wt\ \%)+20.9\ (\text{tempering temperature}=300°\ C.)$$

$$HRC=38\times\sqrt{C}\ (wt\ \%)+15.3\ (\text{tempering temperature}=350°\ C.)$$

After analyzing the effect of each alloy element based on the hardnesses of the carbon steel noted above, it was found that the temper softening resistance ΔHRC in the case of tempering at 300° C. for instance could be described by the following equation.

$$\Delta HRC=4.3\times Si\ (wt\ \%)+7.3\times Al\ (wt\ \%)+1.2\times Cr\ (wt\ \%)\times(0.45+C(wt\ \%))+1.5\times Mo\ (wt\ \%)+3.1\times V\ (wt\ \%)$$

It was found from this result that Al exerted temper softening resistance 1.7 times higher than that of Si and was therefore extremely effective as an element for increasing rolling contact fatigue strength.

Figure 6:
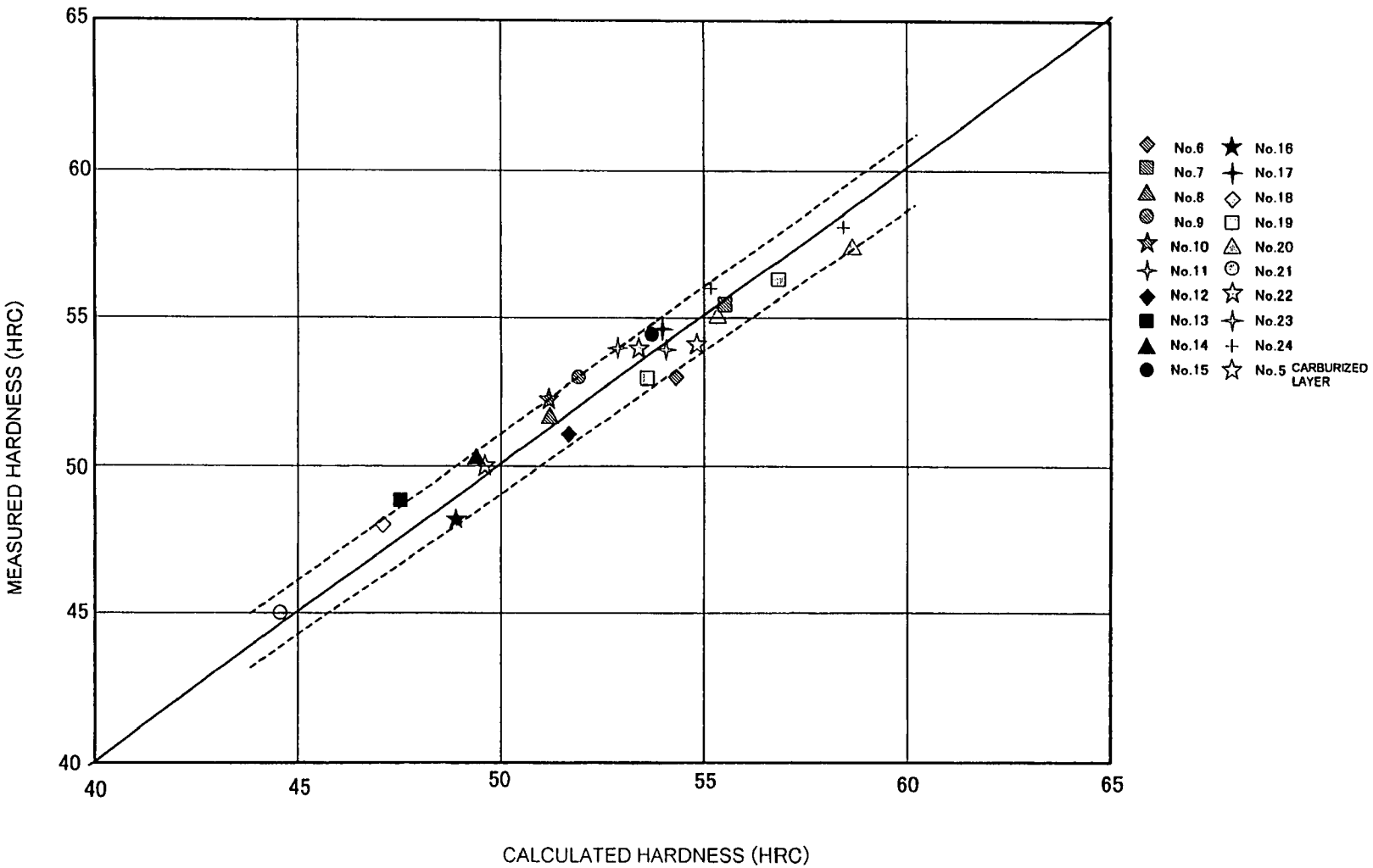
FIG. 6 is a graph showing the comparison between measured values and calculated values of temper hardness (at 300° C.).

FIG. 6 shows the degree of coincidence between the temper hardness obtained from the result of the above analysis and the temper hardness obtained from an actual measurement. It will be understood from FIG. 6 that temper hardness can be accurately estimated with a tolerance of HRC±1. The 300° C.-temper hardness of the carburized layer (0.8 wt % carbon) of SCM420 (No. 5) of Example 1 is indicated by mark ☆ in FIG. 6 and well coincident with the calculated value.

EXAMPLE 3

An Improvement in Pitting Resistance by Use of Steel Materials having Excellent Temper Softening Resistance—1

Table 3 shows the alloy compositions of the steel materials used in this example. The test specimens No. P1 to No. P3 were subjected to tempering at 160° C. for 3 hours subsequently to quenching at 850 to 920° C., whereas the test specimens No. 4 to No. 9 were subjected to induction hardening under the same induction heating condition as in Example 1. A roller pitting test was conducted on these test specimens.

TABLE 3

| | C | Si | Al | Mn | Ni | Cr | Mo | V | Ti | Interface Pressure That Causes Seizure (kgf/cm$^2$) |
|---|---|---|---|---|---|---|---|---|---|---|
| No. P1 | 0.43 | 0.21 | 1.47 | 1.17 | | 0.17 | 0.11 | | | 350 |
| No. P2 | 0.41 | 1.5 | 0.026 | 0.71 | | 0.32 | 0.16 | 0.3 | | 300 |
| No. P3 | 0.61 | 0.25 | 1.47 | 0.93 | 0.98 | 1.04 | 0.35 | | | 325 |
| No. P4 | 0.83 | 1.01 | 0.31 | 0.55 | | 0.96 | | 0.38 | | 375 |
| No. P5 | 0.71 | 0.21 | 0.025 | 0.63 | | 0.16 | 0.04 | 0.93 | | 475 |
| No. P6 | 0.89 | 0.22 | 0.029 | 0.65 | | 0.23 | 0.05 | 1.94 | | 500 |
| No. P7 | 0.64 | 0.23 | 0.031 | 0.65 | | 0.24 | 0.05 | | 0.26 | 450 |
| No. P8 | 0.96 | 0.23 | 0.029 | 0.64 | | 0.23 | 0.05 | | 1.45 | 650 |
| No. P9 | 0.69 | 0.81 | 0.45 | 0.75 | | 0.49 | | 0.99 | | 450 |
| SCM420 + GCQT | | | | | | | | | | 300 |
| SCM440 + QT | | | | | | | | | | 275 |
| SUJ2 + QT | | | | | | | | | | 400 |
| S55C + QT | | | | | | | | | | 275 |

Figure 7:
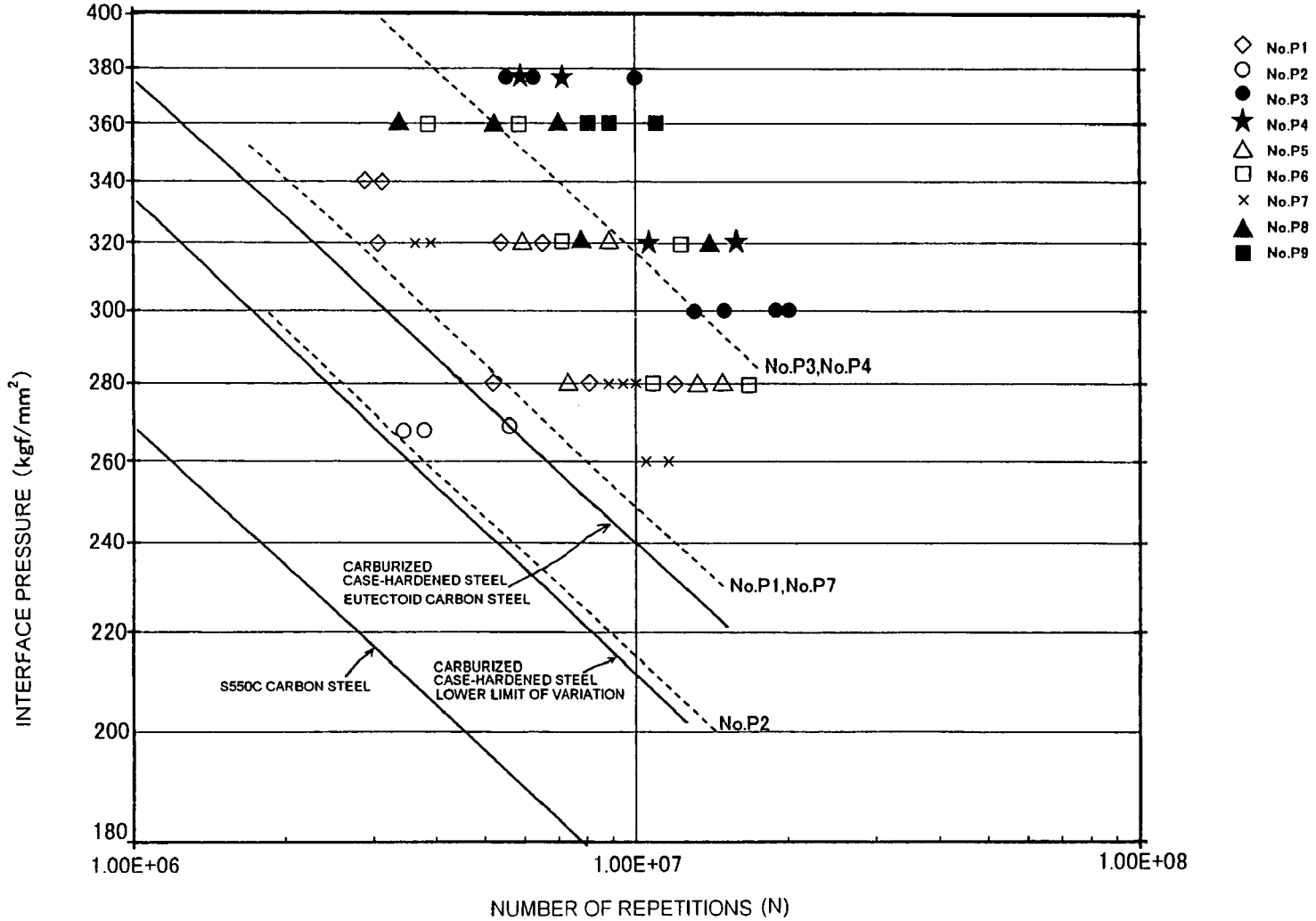
FIG. 7 is a graph (1) showing the pitting resistance of rolling elements produced according to the invention.

The test for checking pitting resistance was carried out under substantially the same condition as in Example 1 and the test result is shown in FIG. 7. The pitting occurrence line obtained in Example 1 is indicated by solid line in FIG. 7, whereas the pitting occurrence line obtained in Example 3 is indicated by broken line in FIG. 7.

It was found from the above result that the pitting resistance of the rolling contact surface could be dramatically improved by sole-addition of Al or Si or co-addition of Al and Si and found from the comparison between the test specimens No. P4 to No. P9 that the pitting resistance of the rolling contact surface could be dramatically improved by addition of V and Ti. It was also found from the comparison between No. 4 and No. 9 and the comparison between No. 5 and No. 6 that significantly improved pitting resistance could be achieved by cementite dispersion.

Figure 8:
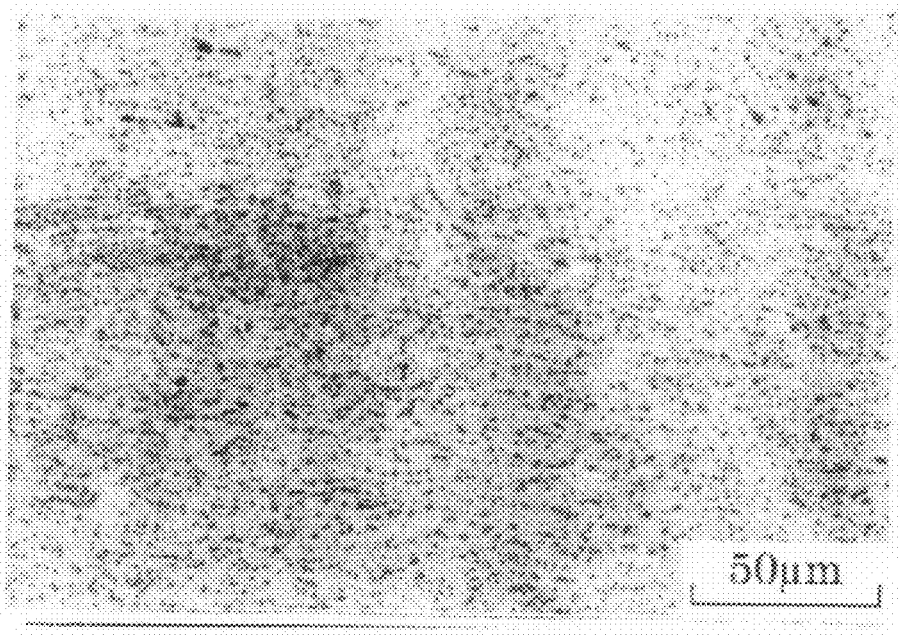
FIG. 8 is a photograph showing the metallographic structure of the rolling contact surface layer of test specimen No. P6.

FIG. 8 shows $V_4C_3$ carbide that disperses within the alloy of No. 6 to which 1.94 wt % V was added. It is understood from FIG. 8 that the particle diameter of the carbide is approximately 1.5 μm or less and the carbide particles uniformly disperse.

EXAMPLE 4

An Improvement in Pitting Resistance by Use of Steel Materials having Excellent Temper Softening Resistance—2

Figure 9:
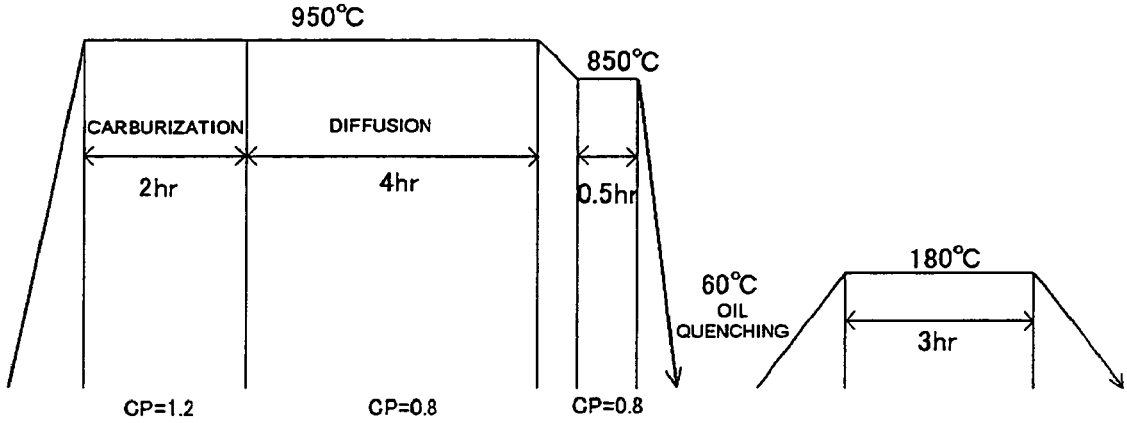
FIG. 9 shows a thermal treatment pattern of a carburizing/quenching/tempering treatment.

Table 4 shows the alloy compositions of the steel materials used in this example. As shown in FIG. 9, No. G1 to No. G5 were subjected to carburization treatment at 950° C. composed of a 2-hour carburization phase (carbon potential (CP)=1.2 wt % C) and a 4-hour diffusion phase (CP=0.8). After temperature was lowered to 850° C., these test specimens were subjected to oil quenching at 60° C. and further subjected to 3-hour tempering at 180° C. (carburizing/quenching/tempering treatment). Another test specimen was prepared, which underwent carbonitriding/quenching/tempering treatment in which a constant temperature phase at 850° C. continued for 2 hours and carbonitriding by use of ammonia gas was carried out in this constant temperature phase. This specimen was also subjected to a roller pitting test under the same conditions as in the forgoing examples.

TABLE 4

| | C | Si | Al | Mn | Ni | Cr | Mo | V | Ti | Interface Pressure That Causes Seizure (kgf/cm$^2$) | — |
|---|---|---|---|---|---|---|---|---|---|---|---|
| No. G1 | 0.28 | 0.22 | 0.024 | 0.74 | 0.03 | 1.01 | 0.16 | | 0.31 | 500 | 550 |
| No. G2 | 0.34 | 0.24 | 0.028 | 0.73 | 0.01 | 0.98 | 0.15 | | 0.61 | 625 | 750 |
| No. G3 | 0.61 | 0.23 | 0.029 | 0.73 | 0.02 | 0.97 | 0.15 | | 1.51 | 675 | 725 |
| No. G4 | 0.41 | 0.25 | 0.031 | 0.74 | 0.02 | 0.99 | 0.16 | 1.1 | | 550 | 600 |
| No. G5 | 0.55 | 0.23 | 0.027 | 0.76 | 0.02 | 0.96 | 0.16 | 1.92 | | 550 | 650 |

Figure 10:
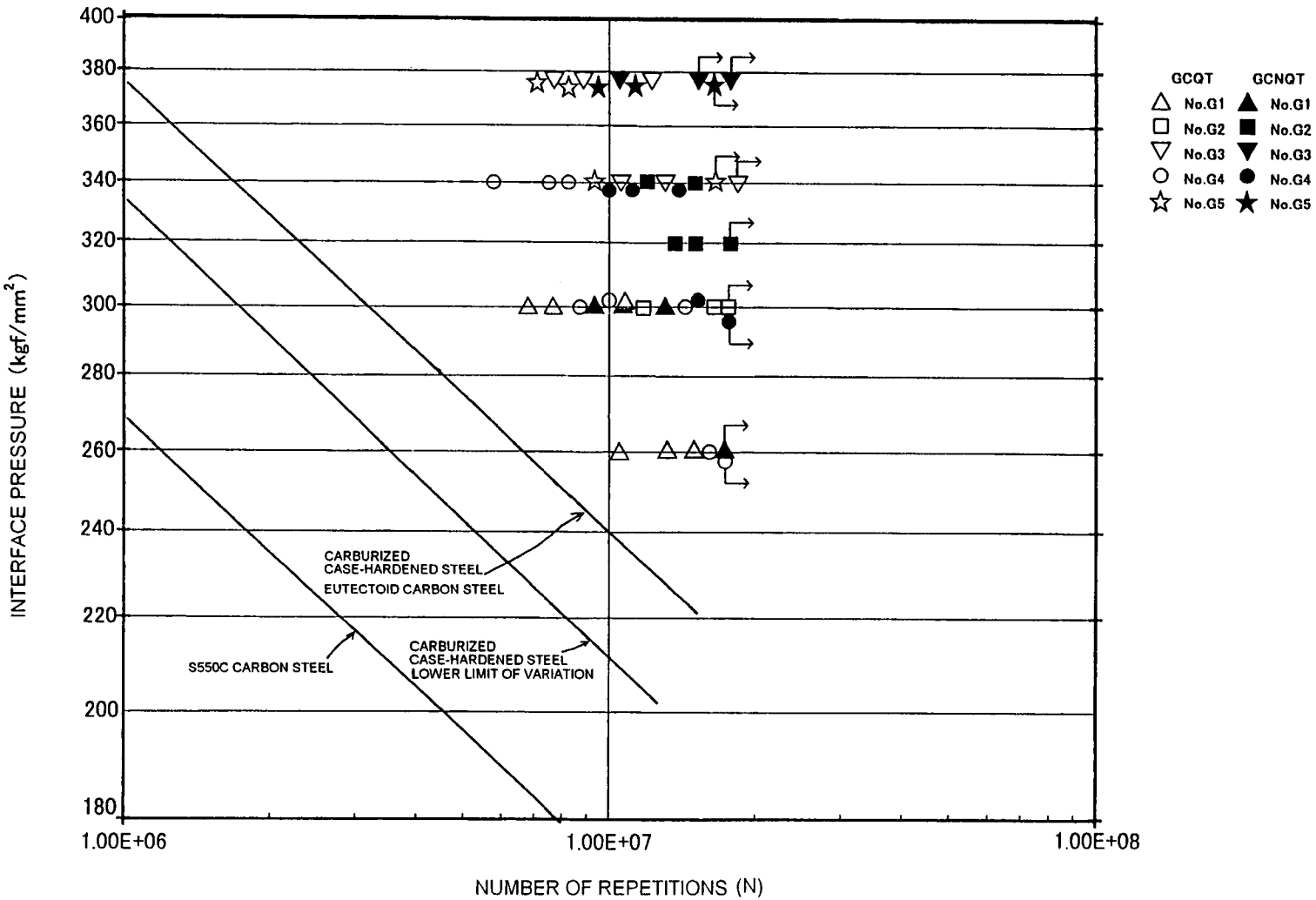
FIG. 10 is a graph (2) showing the pitting resistance of rolling elements produced according to the invention.

FIG. 10 shows the result of the roller pitting test. It is understood from the result that a remarkable improvement in rolling contact fatigue strength is obtained by addition of Ti and V in the test specimen which underwent the carburizing/quenching/tempering treatment and that the rolling contact fatigue strength of the test specimen which underwent the carbonitriding/quenching/tempering treatment is more improved than that of the test specimen which underwent the carburizing/quenching/tempering treatment.

Figure 11:
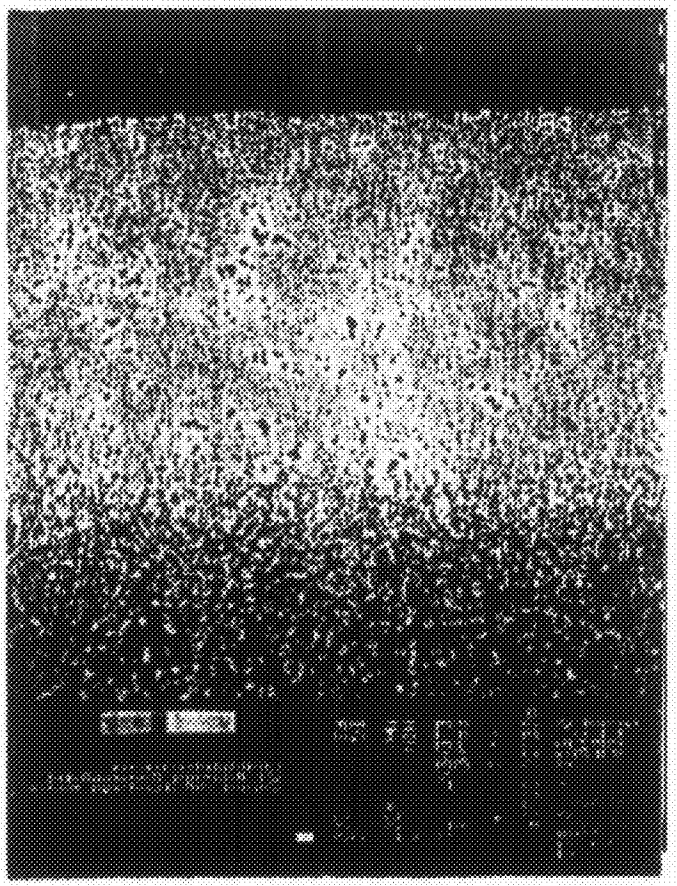
FIG. 11 is a photograph showing the distribution condition of Ti obtained by analyzing, by an X-ray micro analyzer, the rolling contact surface layer of test specimen No. G3 which has undergone a carbonitriding/quenching treatment.
Figure 12:
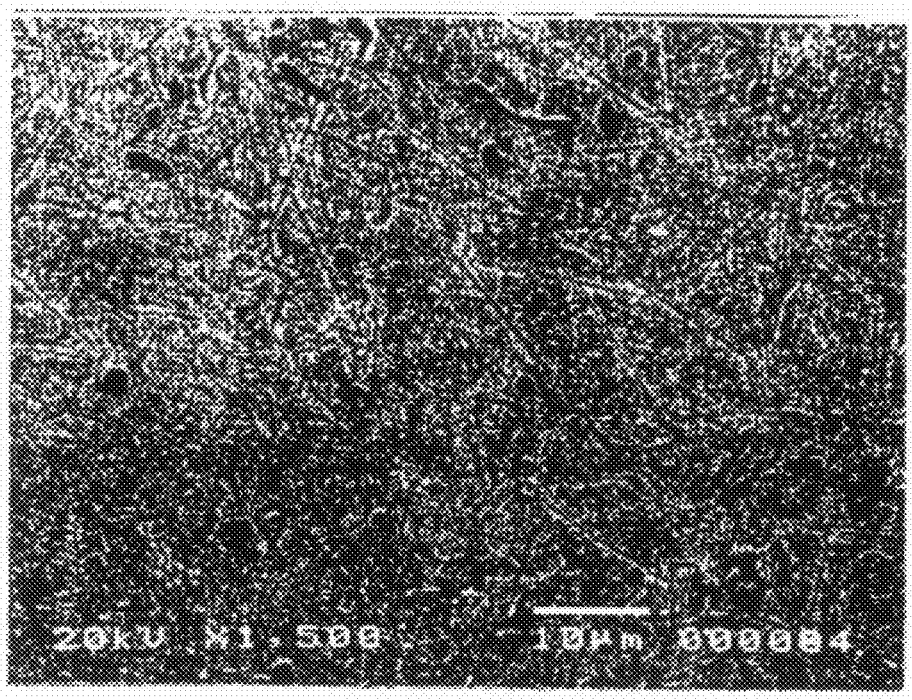
FIG. 12 is a photograph showing the metallographic structure of the rolling contact surface layer of test specimen No. G3 which has undergone the carbonitriding/quenching treatment.

FIG. 11 shows a distributing condition of Ti contained in the carburized, carbonitrided rolling contact surface layer of No. 3 which was checked with an X-ray micro analyzer. FIG. 12 shows an electron microscopic picture of the rolling contact surface layer, from which it is understood that new TiCN is finely, precipitately dispersed by the diffusion and permeation of C and N into the rolling contact surface layer, in addition to originally dispersed TiC.

EXAMPLE 5

An Improvement in Sliding Properties by Dispersion of Carbides, Nitrides and Carbonitrides—1

Figure 13:
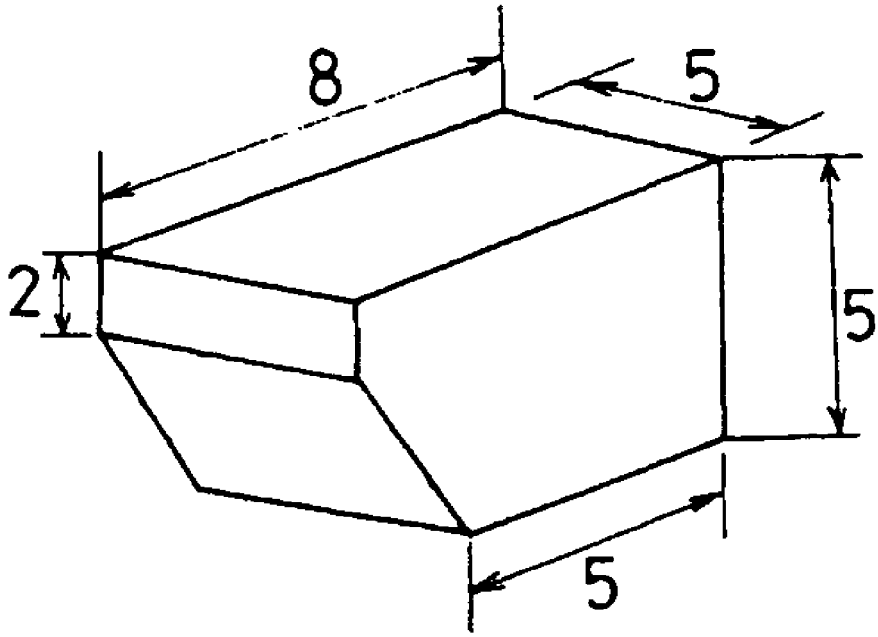
FIG. 13 shows a shape of a test specimen for use in a constant-speed friction test.

In this example, constant speed friction test specimens such as shown in FIG. 13 were prepared from the same steel materials as of Examples 3, 4. A constant speed friction test was conducted on these test specimens being lubricated with an engine oil #30 having a temperature of 80° C. In this test, peripheral velocity was 10 m/sec and a mating member prepared by applying carburizing/quenching/tempering treatment to SCM420 and having a surface hardness of HRC60 was used. The pressure applied to the test specimens was increased 25 kgf/cm$^2$ at a time after held at the same level for 5 minutes, and the pressure (kgf/cm$^2$) at which the friction coefficient suddenly rose (i.e., a seized state) was measured.

The sliding test specimens of the invention shown in Table 3 were quenched from 870° C. and tempered at 160° C. for 3 hours. The sliding test specimens shown in Table 4 were subjected to the thermal treatment of Example 4. A comparative material (SCM420+GCQT) prepared by applying carburizing/quenching/tempering treatment to SCM420 was used. Also, comparative materials (SCM 440+QT), (S55C+QT), and (SUJ2+QT) prepared by applying quenching/tempering treatment to SCM44040, S55C and SUJ2 respectively were used.

The result of the friction test is shown in Tables 3 and 4 from which it is clearly understood that the seizure resistance of Nos. P4 to P9 and Nos. G1 to G5 was markedly improved by the effect of the dispersion of the hard particles. Among all, the effect of Ti addition upon the improvement of the seizure resistance is marvelous.

EXAMPLE 6

Confirmation of the Dispersing Condition and Wear Resistance of Cementite Particles In this example, in order to confirm that cementite is densely dispersed in the martensite parent phase and the wear resistance of a rolling element subjected to a sliding condition can be markedly improved, the steel materials shown in Table 1 were induction hardened under various conditions while each structure before the induction hardening being controlled. And, the quenched structure of each material was observed and its wear resistance was examined.

Figure 14:
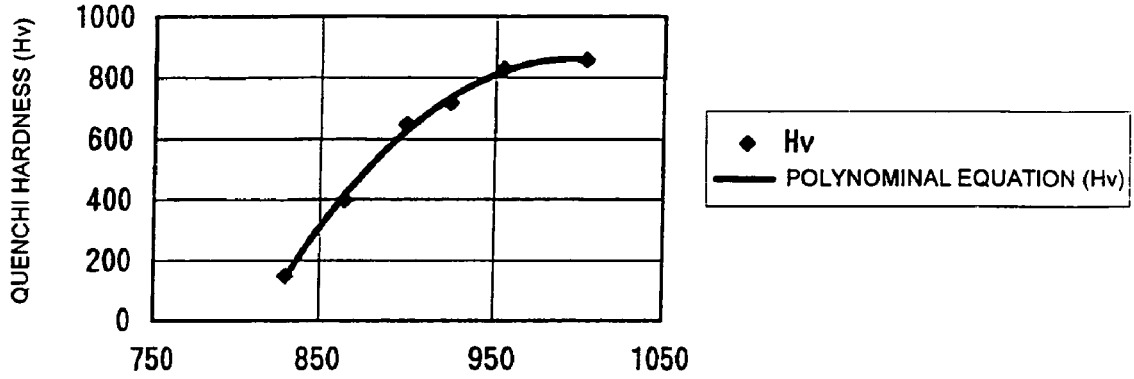
FIG. 14(*a*) is a graph showing the relationship between induction heating temperature and quench hardness, FIG. 14(*b*) is a graph showing the relationship between induction heating temperature and the C concentration of martensite (6° C./sec), and FIG. 14(*c*) is a graph showing the relationship between induction heating temperature and the volume percent of a θ phase.
Figure 14:
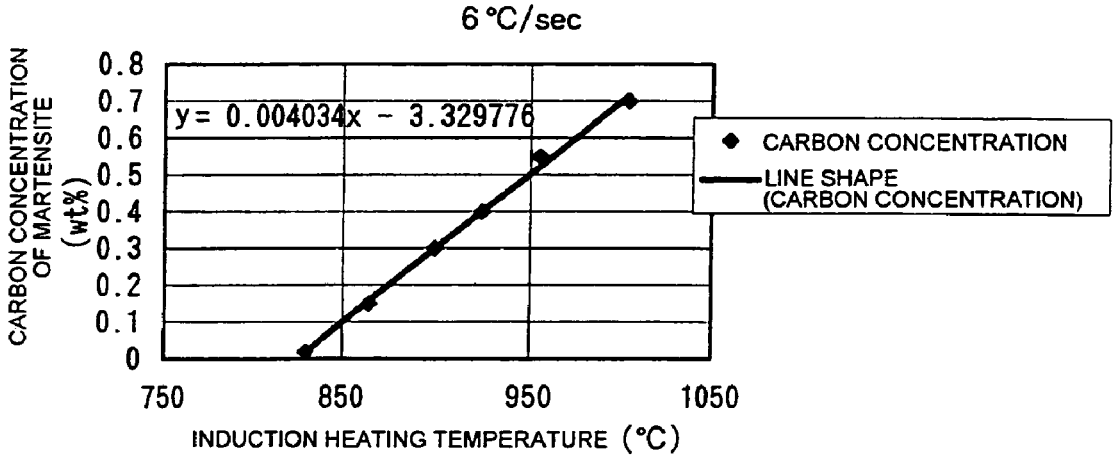
Figure 14:
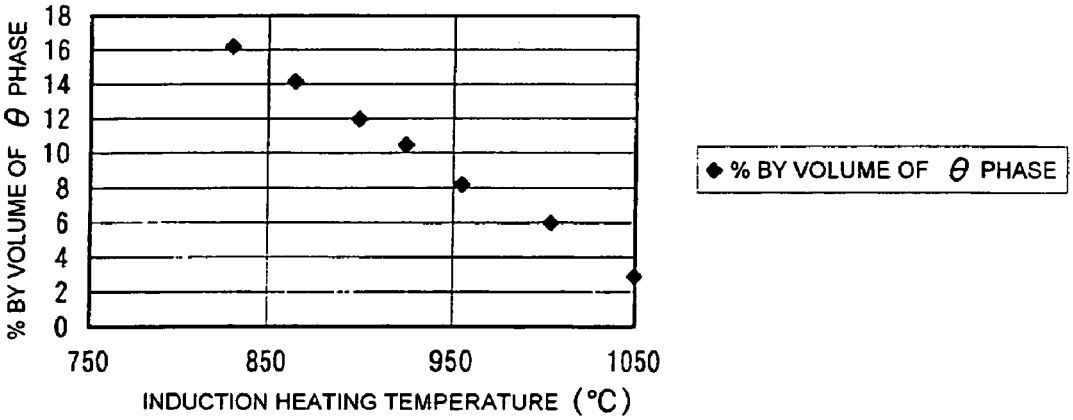

FIGS. 14(*a*), 14(*b*), 14(*c*) show the result of a survey for examining the relationship between the carbon concentration of martensite and the amount of undissolved cementite from the hardness of a quenched layer obtained when the steel material No. 4 (corresponding to SUJ2) in Table 1 was heated at 810° C. for 2 hours and after spheroidizing (slow cooling process) the cementite through slow cooling to 600° C., the steel material was heated by induction heating at a heating speed of 6° C./sec to temperatures of 800 to 1000° C., followed by water quenching. As seen from these figures, the solid dissolving of cementite into austenite during the heating is retarded by the concentration of Cr into the cementite (about 9 wt % Cr) and a heating temperature of at least 900° C. or more is required for obtaining martensite having enough hardness as a rolling element. In addition, the carbon concentration of the martensite at that time is about 0.3 wt % and 12% by volume hard cementite particles are dispersed, and from these facts, it is understood that the steel material No. 4 has good seizure resistance (scoring resistance), pitting resistance and wear resistance as a gear material.

It is understood that when the temperature of the induction heating is set to 1000° C., a very hard quench-hardened layer can be obtained in which about 6% by volume cementite disperses in a martensite parent phase containing 0.7 wt % C. However, the martensite should satisfy any of the following conditions as a rolling element, when taking account of the fact that, at an induction heating temperature of 1000° C., the amount of the retained austenite phase increases so that the hardness of the quench-hardened layer becomes saturated. The conditions are (1) the temperature of the induction hardening is 1050° C. or less in view of the possibility of occurrence of quench crack; (2) the carbon content of the martensite is 0.7 wt % or less; and (3) the dispersing amount of the cementite is 2% by volume.

A steel material (No. W3 in Table 5 described later) having a composition of Fe—0.98 wt % C—0.55 wt % Si—1.11 wt % Mn—1.08 wt % Cr was subjected to the above-described spheroidizing process. Meanwhile, the same material was kept at 820° C. for 1.5 hours and then cooled by air, whereby pearlitic cementite and granular cementite were dispersed. These steel materials were heated to temperatures of 900 to 1100° C. at a high heating speed of 1000° C./sec that was extremely higher than the normal induction heating speed. Thereafter, the structure of the quenched sliding contact surface of each material was checked.

Figure 15:
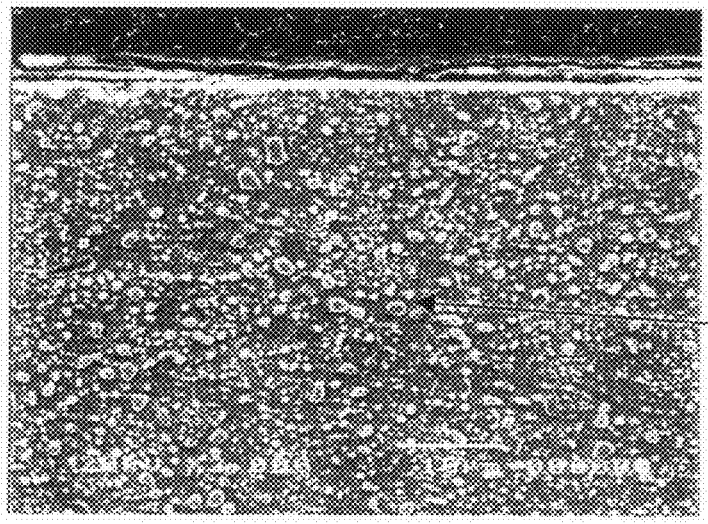
FIG. 15 is a photograph showing a quench hardened structure wherein granular cementite is dispersed.
Figure 16:
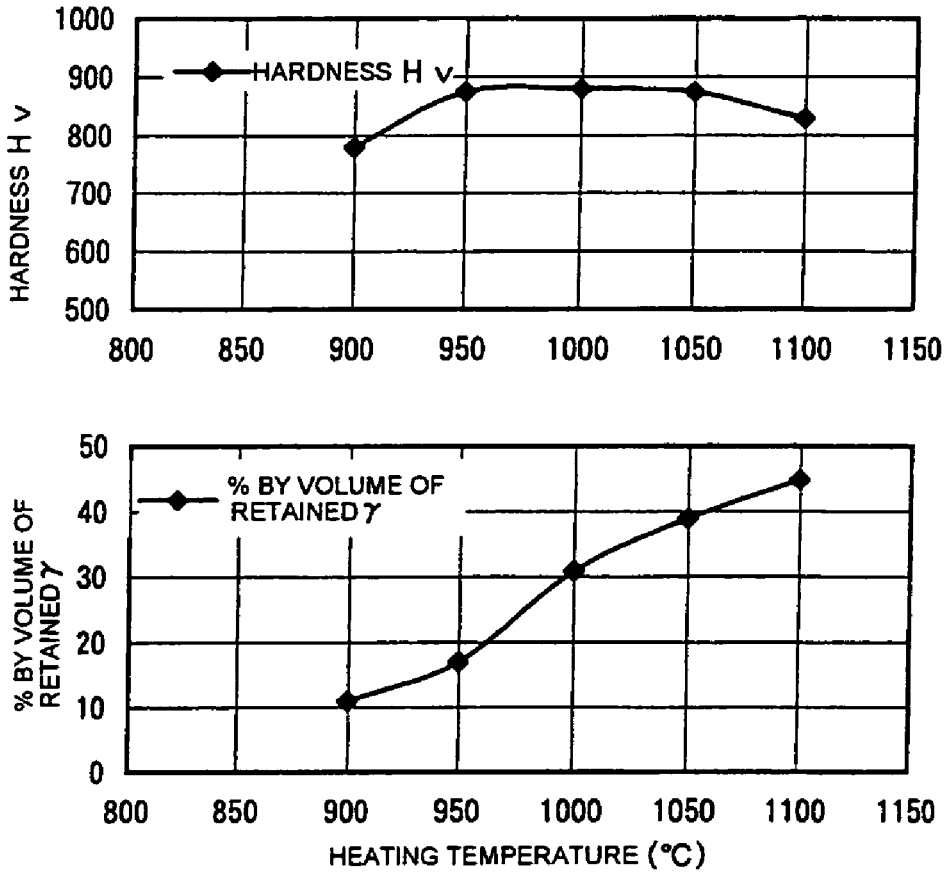
FIG. 16 is a graph showing the relationship between heating temperature, quench hardness and residual amount Y.

FIG. 15 shows the structure of the above material which was subjected to the spheroidizing process (slow cooling) and quenching from a heating temperature of 1000° C. In this structure, granular cementite is densely dispersed. The quenched layer was significantly hardened to up to Hv 830 as seen from FIG. 16 although it contains 30 to 45% by volume retained austenite. From this, it is understood that up to 50% by volume retained austenite does not affect the wear resistance of the quenched structure. It can be clearly seen that the retained austenite of the above quenched structure significantly increases, compared to the retained austenite obtained when SUJ3 is oil-quenched in a conventional manner from a furnace heating temperature of 830° C.

Figure 17:
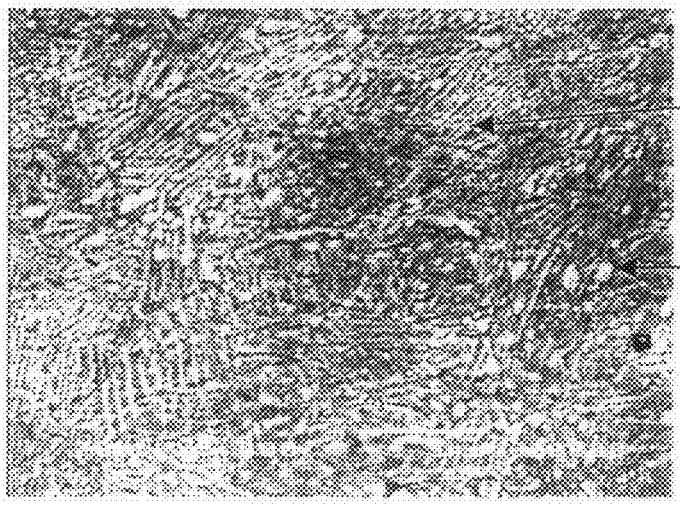
FIG. 17 is a photograph showing a quench hardened structure wherein pearlitic cementite is dispersed.

FIG. 17 shows the structure of the sliding contact surface of the steel material having pearlitic cementite and granular cementite dispersed therein and quenched after heating to 1000° C. at a heating speed of 1000° C./sec. It is seen from the photograph of FIG. 17 that plate-like cementite having pearlite structure is dispersed in the martensite parent phase and the steel material is more significantly hardened (Hv 940) than the hardness (Hv 880) of the structure shown in FIG. 15.

The relationship between heating temperature and the heating speed at which pearlitic cementite disperses was checked, using the steel material having pearlite precursor. As a result, it was found that pearlitic cementite dispersed in the quenched structure obtained after heating to 900° C. at a heating speed of 150° C./sec and the quench-hardened layer of this material was markedly hardened to Hv 945. For at least achieving stable cementite dispersion, a heating speed of 100° C./sec or more is necessary when the lower limit of heating temperature is 850° C., and a more preferable heating speed is 150° C./sec or more. The speed of rapid heating after passing the Al temperature until a quenching temperature of 1050° C. is reached is preferably 3 seconds or less.

FIGS. 15, 17 show the Cr concentrations of the granular and pearlitic cementites analyzed by EDAX (Energy Dispersive Analysis of X-ray) using an electron microscope. Although it can be observed that Cr remarkably concentrates in the pearlitic cementite, the Cr concentration of the pearlitic cementite is lower than that of the granular cementite and therefore the pearlitic cementite is more liable to solid dissolving. By carrying out a heating process such that Cr is allowed to further concentrate in the pearlitic cementite in the structure before quenching, the pearlitic cementite can be more stably dispersed.

The carbon concentration of the martensite obtained from a measurement of the lattice constant of the martensite phase of the steel material No. 1 subjected to rapid heating and quenching is 0.5 wt %. Compared to the foregoing test result (0.7 wt %) associated with No. 1, the soluble carbon concentration of No. 1 lowers owing to rapid induction heating, so that the dispersing amount of cementite increases. This is desirable for achieving improved contact fatigue strength and wear resistance.

Figure 18:
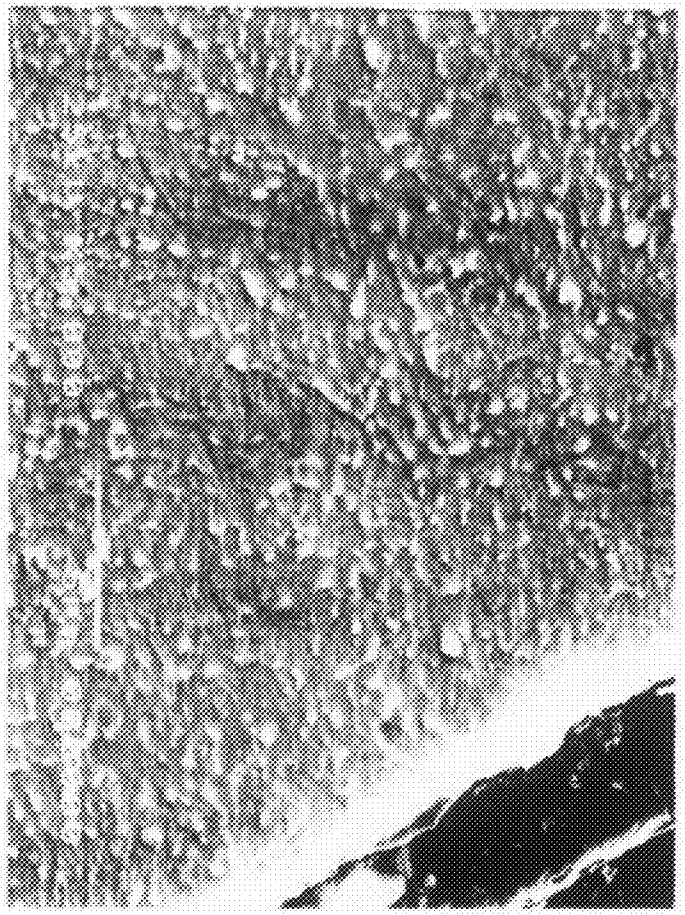
FIG. 18 is a photograph showing a quench hardened structure of alloy element No. W2 wherein cementite is spheroidized by quenching/tempering.

FIG. 18 shows a structure obtained by quenching the steel material No. W2 (corresponding to SCM453) containing 0.53 wt % carbon and shown in Table 5 described later. This steel material was spheroidized, and quenched after induction heating to 1000° C. at a heating speed of 1000° C./sec. As seen from FIG. 18, sufficient fine cernentite particles having an average particle diameter of about 0.2 μm are allowed to remain, providing improved contact fatigue strength, seizure resistance and wear resistance to the resulting rolling element (gear) produced from a low-carbon steel material.

Steel materials having various cementites dispersed therein were quenched after heating to 1000° C. at a heating speed of 1000° C./sec in the same manner as described earlier. These steel materials underwent a roller pitting test under a slipping condition at an interface pressure of 240 kgf/mm$^2$. After $2\times10^6$ cycles were done, the wear depth (μm) of each steel material in the form of a small roller was measured for evaluation of the wear resistance of the rolling contact surface layer. Table 5 shows the evaluation result. It is apparent from Table 5 that improved wear resistance can be achieved by dispersion of 2% by volume or more cementite. From the comparison between the wear resistance of the steel materials and the wear resistance of the rolling contact surface subjected to the conventional carburizing quenching treatment (the carburized, quenched SCM420 shown in Table 5), it is understood that dispersion of 2% by volume or more cementite is beneficial.

The structures in which pearlitic cementite is dispersed in the martensite parent phase have wear resistance superior to that of the structures containing granular cementite dispersed therein.

TABLE 5

| | C | Si | Al | Mn | Ni | Cr | Mo | % bv volume of cementite | wear amount (μm) |
|---|---|---|---|---|---|---|---|---|---|
| No. W1 | 0.46 | 0.22 | 0.018 | 0.76 | | 0.8 | | 1.2 (granular) | 4.1 |
| No. W2 | 0.53 | 0.21 | 0.021 | 0.78 | | 0.98 | 0.16 | 2.5 (granular) | 2.3 |
| No. W3 | 0.98 | 0.55 | 0.023 | 1.11 | | 1.08 | | 5.8 (granular) | 0.9 |
| No. W3 | | | | | | | | 6.2 (pearlitic) | 0.4 |
| No. W4 | 0.84 | 1.12 | 0.019 | 0.4 | | 0.91 | | 5.8 (pearlitic) | 0.7 |
| No. W5 | 0.5 | 0.88 | 0.022 | 0.75 | | 0.12 | | 0 | 8.9 |
| S55C | 0.55 | 0.23 | 0.025 | 0.71 | | | | 0 | 12 |
| S80C | 0.79 | 0.22 | | 0.75 | | 0.13 | | 0 | 7.3 |
| carburized quenched SCM420 | | 0.23 | 0.024 | 0.78 | | 1.01 | 0.17 | 0 | 3.8 |

What is claimed is:

1. A rolling element having a rolling contact surface layer, which is made from a steel material which comprises at least 0.2 to 0.8 wt % C, 0.3 to 1.5 wt % Cr and 0.2 to 2.0 wt % in total of one or more alloy elements selected from the group consisting of V, Ti, Zr, Nb, Ta and Hf, and in which a total of 0.4 to 4.0% by volume of carbides of said alloy elements having an average particle diameter of 0.2 to 5 μm and 7.5 to 20% by volume of cementite are dispersed therein;

wherein the rolling contact surface has been carbonitrided or nitrided so that one or more compounds selected from the group consisting of nitrides and carbonitrides of an element selected from the group consisting of V, Ti, Zr, Nb, Ta and Hf, and having an average particle diameter of 0.2 μm or less are additionally precipitately dispersed in the rolling contact surface layer; and the carbon content of the rolling contact surface layer is adjusted to 0.65 to 1.5 wt % and the nitrogen content of the rolling contact surface layer is adjusted to 0.1 to 0.7 wt %, while 7.5 to 20% by volume of the cementite is dispersed therein;

wherein cementite has been spheroidized by thermal treatment and cooling after carbonitriding or nitriding, thereby allowing Cr to concentrate in the cementite and the rolling contact surface layer is further induction hardened by induction heating to form austenite grains and quench hardened to form martensite, followed by low- temperature tempering;

wherein 2 to 15% by volume of the spheroidized cementite containing 2.5 to 10 wt % Cr as an average composition are dispersed in an undissolved condition in a martensite parent phase of the rolling contact surface layer by the spheroidizing and a soluble carbon concentration in the martensite parent phase of the rolling contact surface layer is adjusted to 0.35 to 0.8 wt % by induction heating.

2. The rolling element according to claim 1 wherein the austenite grains in the rolling contact surface layer formed by the induction heating have a particle size equal to or greater than the level of ASTM No. 10 and wherein after the quench hardening, retained austenite is formed in the rolling contact surface layer, and the amount of retained austenite is adjusted to 10 to 50% by volume.

3. The rolling element according to claim 1 wherein said steel material contains 0.5 to 3.0 wt % Si, 0.20 to 1.5 wt % Al or 0.5 to 3.0 wt % (Si +Al),and further contains one or more elements selected from the group consisting of Mn, Ni, Mo, Cu, W, B and Ca, unavoidable impurity elements P,S,N and O, and the balance being Fe.

4. The rolling element according to claim 3, wherein said steel material further comprises 0.3 to 1.5 wt % Ni and 0.2 wt % or more Al.

5. The rolling element according to claim 4, wherein cementite and retained austenite are dispersed in a quench hardened layer of the steel material.

6. The rolling element according to claim 3, wherein said steel material further comprises one or more alloy elements selected from the group consisting of 0.2 to 1.5 wt % Mn; 0.5 wt % or less Mo; and 0.5 wt % or less W.

7. The rolling element according to claim 1 wherein after carbonitriding or nitriding the rolling contact surface layer is quench hardened by induction hardening in which rapid cooling is carried out after rapid induction heating is completed within 10 seconds in a temperature region of the A1 temperature of the steel material to a quenching temperature of 900 to 1050°C.

8. The rolling element according to claim 7, wherein the rolling element has teeth and the quench hardened layer is formed along the contour of the teeth by a quenching subsequent to the induction heating.

9. The rolling element according to claim 1, which is a gear having teeth used under a slipping condition and wherein a compressive residual stress of at least 50 kgf/mm$^2$ or more remains at the roots of the teeth.

10. The rolling element according to claim 9, wherein the compressive residual stress is generated by mechanical means.

11. The rolling element according to claim 1 produced by induction heating, quenching and tempering a steel material after carbonitriding or nitriding, the steel material comprising (i) 0.2 to 0.8 wt % C; (ii) 0.5 to 3.0 wt % Si, 0.2 to 1.5 wt % Al or 0.5 to 3.0 wt % (Si +Al); and (iii) 0.2 to 2.0 wt % in total of one or more alloy elements selected from the group consisting of V, Ti, Nb, Zr, Ta and Hf, wherein the steel material further comprises 0.3 to 1.5 wt % Ni and unavoidable impurity elements P, S, N or O, and the balance being Fe.

12. The rolling element according to claim 1 produced by induction heating, quenching and tempering a steel material after carbonitriding or nitriding, the steel material comprising (i) 0.2 to 0.8 wt % C; (ii) 0.5 to 3.0 wt % Si, 0.2 to 1.5 wt % Al or 0.5 to 3.0 wt % (Si +Al); and (iii) 0.2 to 2.0 wt % in total of one or more alloy elements selected from the group consisting of V, Ti, Nb, Zr, Ta and Hf, wherein the steel material contains 1.0 to 2.5 wt % (Mn +Ni), 0.5 to 1.5 wt % Cr and 0.35 wt % or less Mo or contains 0.0005 to 0.005 wt % B in addition to 1.0 to 2.5 wt % (Mn +Ni), 0.5 to 1.5 wt % Cr and 0.35 wt % or less Mo, and wherein the steel material further contains unavoidable impurity elements P, S, N or O, and the balance being Fe.

13. The rolling element according to claim 10 wherein the mechanical means is shot peening.

* * * * *